US007381238B2

(12) United States Patent
Dardik et al.

(10) Patent No.: US 7,381,238 B2
(45) Date of Patent: Jun. 3, 2008

(54) SYSTEM AND METHOD OF ELECTROMAGNETIC INFLUENCE ON ELECTROCONDUCTING CONTINUUM

(75) Inventors: Irving I. Dardik, Califon, NJ (US); Arkady K. Kapusta, Beer Sheva (IL); Boris M. Mikhailovich, Beer Sheva (IL); Ephim G. Golbraikh, Beer Sheva (IL); Shaul L. Lesin, Meitar (IL); Herman D. Branover, Omer (IL)

(73) Assignee: Energetics Technologies, L.L.C., Califon, NJ (US)

( * ) Notice: Subject to any disclaimer, the term of this patent is extended or adjusted under 35 U.S.C. 154(b) by 0 days.

(21) Appl. No.: 11/712,786

(22) Filed: Feb. 28, 2007

(65) Prior Publication Data

US 2007/0157996 A1 Jul. 12, 2007

Related U.S. Application Data

(62) Division of application No. 10/738,910, filed on Dec. 16, 2003.

(60) Provisional application No. 60/517,359, filed on Nov. 4, 2003, provisional application No. 60/434,230, filed on Dec. 16, 2002.

(51) Int. Cl.
*H05B 6/34* (2006.01)
*H05B 6/36* (2006.01)

(52) U.S. Cl. ..... 75/10.14; 75/10.16; 373/146

(58) Field of Classification Search ..... 75/10.14, 75/10.16; 373/146
See application file for complete search history.

(56) References Cited

U.S. PATENT DOCUMENTS

| | | | | |
|---|---|---|---|---|
| 2,963,758 | A | 12/1960 | Pestel et al. | |
| 3,759,635 | A | 9/1973 | Carter et al. | |
| 4,321,958 | A | 3/1982 | Delassus | |
| 4,749,026 | A | 6/1988 | Metz et al. | |
| 4,906,877 | A | 3/1990 | Ciaio | |
| 4,927,460 | A * | 5/1990 | Simcock | 75/10.14 |

(Continued)

FOREIGN PATENT DOCUMENTS

| | | |
|---|---|---|
| DE | 307225 | 10/1917 |

(Continued)

OTHER PUBLICATIONS

Irving I. Dardik Article, "The Great Law of the Universe," Mar./Apr. (V. 44, No. 5) 1994 issue of the "Cycles" Journal.

(Continued)

*Primary Examiner*—Roy King
*Assistant Examiner*—Tima M McGuthry-Banks
(74) *Attorney, Agent, or Firm*—Greenberg Traurig, LLP

(57) ABSTRACT

Thus, as shown by an exact electrodynamic computation of EMBF and the estimations described above of the velocity of turbulent flows arising due to their effect, application of amplitude- and frequency-modulated helically traveling (rotating and axially traveling) electromagnetic fields in metallurgical and chemical technologies and foundry can considerably increase the hydraulic efficiency of MHD facilities, intensify the processes of heat and mass transfer in technological plants, significantly increase their productivity, considerably decrease energy consumption for the production of metals, alloys, cast articles, and chemical products, and improve their quality.

3 Claims, 20 Drawing Sheets

U.S. PATENT DOCUMENTS

| | | | | |
|---|---|---|---|---|
| 5,279,351 | A * | 1/1994 | Metz | 164/468 |
| 6,402,367 | B1 | 6/2002 | Lu et al. | |
| 6,618,426 | B1 * | 9/2003 | Ernst | 373/146 |

FOREIGN PATENT DOCUMENTS

| | | | |
|---|---|---|---|
| DE | 911425 | | 4/1954 |
| EP | 0 005 676 | A2 | 11/1979 |
| EP | 0 080 326 | A1 | 6/1983 |
| JP | 6 315 740 | A | 11/1994 |
| JP | 10-144521 | | 5/1998 |
| WO | WO-80/01999 | A1 | 10/1980 |
| WO | WO-99/12678 | A1 | 3/1999 |

OTHER PUBLICATIONS

Tatterson, G.B., Calabrese, R.V., and Penney, "Industrial Mixing Technology: Chemical and Biological Applications," American Institute of Chemical Engineers, W.R. 1994.

Irving I. Dardik Article, "The Law of Waves and the Invalidation of the Scientific Method," Feb. (V. 45, No. 2) 1995 issue of the "Cycles" Journal.

Irving I. Dardik Article, "Superwaves: The Reality that is Existence," (available at: http://www.dardikinstitute.org/04.html), 2002.

E. Golbraikh, A. Kapusta, and B. Mikailovich Presentation, "Semiempirical Model of Turbulent Rotating MHD Flows," Proc. 5th Internal. PAMIR Conf., Ramatuelle, France, Sep. 16-20, 2002, I-227-I-230.

* cited by examiner

SYSTEM AND METHOD OF ELECTROMAGNETIC INFLUENCE ON ELECTROCONDUCTING CONTINUUM

CROSS REFERENCE TO RELATED APPLICATION

This application is a divisional of U.S. patent application Ser. No. 10/738,910, filed Dec. 16, 2003, which claims priority from U.S. Provisional Patent Application No. 60/434,230, filed Dec. 16, 2002, and from U.S. Provisional Patent Application No. 60/517,359, filed Nov. 4, 2003, each of which is hereby incorporated by reference herein in its entirety.

BACKGROUND OF THE INVENTION

The present invention is related, in general, to methods involving electromagnetic forcing impact upon conducting media, and in particular, to such methods that can be applied for profound intensification of metallurgical processes.

Methods of forcing influence upon conducting media using rotating, traveling, or helically traveling magnetic fields are well known and sufficiently widely used for the intensification of various metallurgical processes, such as melting, alloying, purification from detrimental impurities, crystallization of continuous ingots and castings, etc. However, metallurgical process rates and final product quality obtained using the known methods can be considerably increased using the proposed method.

Methods of controlling the crystalline structure of continuous and stationary ingots and castings using rotating or traveling magnetic fields have been known since long ago (patents by Kurt (German Patent No. 307225, 1917), Jungans and Schaber (FRG Patent No. 911425, 1954), Pestel et al. (U.S. Pat. No. 2,963,758, 1960), each of which is hereby incorporated by reference in its entirety). Experimental material accumulated in this field shows that the application of rotating or traveling magnetic fields eliminates the columnar structure of cast products and makes it possible to produce ingots and castings with equiaxial fine-grain dense structures, which positively affects their mechanical properties. However, turbulence level in liquid metals achieved by conventional methods limits the application range of magnetohydrodynamic (MHD) impact in metallurgical technologies.

Therefore, a significant increase in the efficiency of the methods of MHD impact on melts in the process of their crystallization is a rather urgent problem.

In a related field, there is a known method of continuous treatment of cast iron melts in a rotating magnetic field excited by non-modulated three-phase currents in facilities built for this purpose. These facilities are made in the form of an inclined lined channel with a receiving funnel and a ladle lip, around which explicit-pole inductors exciting RMF in the melt are arranged.

The maximal desulfurization rate attained in this facility using soda ash and magnesium powder in the capacity of desulfurizers amounts to about 10 relative % per second, and about 50% of the sulphur was removed. At the facility productivity of about 120 tons per hour was achieved, and electric energy consumption amounts to about 2 kilowatt hours per ton.

Despite relatively good technological results achieved on such a facility, the absolute desulfurization depth is relatively low, and thermal losses are very high due to the impossibility of applying a sufficiently thick lining in the mentioned facility.

In another related field, in typical channel induction furnaces, the melt located in the furnace shaft is stirred mainly at the expense of thermal convection, because the melt in the channels is always overheated in comparison with the melt in the shaft. Furthermore, in the upper part of the channels, a certain pressure gradient appears directed towards the shaft and connected with the inhomogeneity of the induced current density field. The intensity of melt stirring in the shaft is low, which increases the time duration required for the homogenization of the melt temperature and composition in the furnace, and prevents an increase in the furnace capacity at the expense of increasing the shaft height. It would be desirable to increase the intensity of melt stirring, thereby reducing the time required to process the melt.

SUMMARY OF THE INVENTION

It is therefore an object of the present invention to provide a method of controlling the crystalline structure of continuous and stationary ingots and castings of ferrous and non-ferrous metals using one or several helically traveling magnetic fields excited in the melt by m-phase systems of amplitude-, frequency- and phase-modulated currents (or by currents with various combinations of mentioned modulation types). As estimations demonstrate below, at a certain choice of modulation parameters, the amplitude of the non-stationary (i.e., time-dependent) component of the electromagnetic body forces ("EMBF") field is much higher than that of a stationary (i.e., time-independent) one, which allows more efficient stirring of the liquid cores of ingots and castings than in the case of conventional methods due to an increased turbulence intensity. Furthermore, at a certain combination of modulation parameters, EMBF can be changed with time in a periodic pulse-wise manner, which ensures a dense fine-crystalline equiaxial structure of ingots and castings. Application of helically traveling magnetic fields with three and more controllable parameters allows a fine control of the force effect of the helically traveling magnetic fields on the crystalline melt providing for optimal casting technology in each individual case.

Electrodynamic estimations have shown that at the application of frequency- and amplitude-modulated RMF according to the invention, peak values of electromagnetic body forces grow in comparison with a non-modulated RMF at a rate disproportionately higher than the additional energy used to create the modulated MHD dictates. The growth in peak values of EMBF occurs because the non-stationary component of an EMBF field according to the invention comprises high-frequency harmonics that excite small-scale vortices intensifying heat- and mass-transfer. Thus, as experiments have demonstrated, the application of magnetic fields modulated by this method increases the density and hardness of castings. An increased number of controllable parameters of the process, such as amplitude modulation depth and frequency, frequency modulation deviation and frequency, force impact duration, etc., further provide for a more flexible control of the crystallization process and the production of ingots and castings with crystalline structures required for technological needs in each specific case.

The present invention also proposes a method of continuous out-of-furnace alloying of liquid metals in a flow of ferrous metal melts for purification from detrimental impurities, and a facility realizing this method, which allows a drastic increase in the intensity of melt stirring at a lower power of inductors, at a facility with smaller dimensions, and with a simultaneous increase in the lining thickness and decrease in heat loss.

To realize these advantages, frequency- and amplitude-modulated currents are applied to the winding of the inductors in the facility, which excite a helically traveling modulated magnetic field, which in turn excites mirror-reflected modulated currents in the melt flowing through the channel. The interaction of these currents with the magnetic field generates electromagnetic body forces, whose stationary component during a period exceeds the stationary component of EMBF excited by a non-modulated magnetic field, and whose non-stationary component excites the small-scale vortical structure, which increases turbulence intensity. Therefore, the intensity of stirring the melt with alloying additives or with reagents intended for the removal of detrimental impurities is drastically increased.

To realize this method, a cardinal change in the facility design may be implemented by changing the design of inductors. The inductors may be designed to operate at temperatures in the range of 800-900° C. The ability to operate at such temperatures, for example, permits the installation of the inductors in the lining of the facility. For this purpose, a method of the present invention makes the magnetic circuit of the inductor from so-called ferroceramics representing a refractory material (e.g., chamotte, magnesite, chromomagnesite, or high-temperature concrete) with a filler representing iron or cobalt powder. The powder particle size may be 1 mm, for example, and the powder content in the refractory material may depend on the type of the refractory material used. After thorough stirring, such a material is produced in the form of individual elements with its shape depending on the design of a specific furnace, and then the material is baked. Up to the Curie temperature of the filler, the material retains its magnetic properties, is not electroconducting, has a sufficiently low thermal conductivity, and can be used simultaneously as both the magnetic circuit of the inductor and the lining of the facility.

Such a design of an RMF inductor makes it possible to arrange the RMF source maximally close to the melt and to reduce the required inductor power. Since the inductor coils are also located in the high-temperature zone, their design also greatly differs from inductor coils conventionally applied in metallurgical technology.

The proposed method of the present invention of intensification of technological processes in channel induction furnaces and alterations introduced into their design make a considerable contribution to the improvement of the technological plants.

It is yet another object of the present invention to provide a method of intensification of melt stirring in furnaces, wherein the currents in the primary windings of an m-phase furnace transformer are synchronously or cophasally frequency- and amplitude-modulated by periodic in time functions. As estimations shown below, at a certain choice of modulation parameters, the MHD force impact on the melt grows to a greater extent than the energy consumed for modulation, which homogenizes melt temperature in the channels of induction channel furnaces. Furthermore, the melt contained in the furnace shaft is affected by a traveling (rotating) magnetic field modulated by the method of the present invention, which homogenizes melt temperature and chemical composition in the shaft of induction furnaces and arc furnaces. Designs of induction and arc furnaces with inductors built into the lining and intended for the realization of said MHD impact are also proposed.

It is an object of the present invention to provide a method of forcing influence on electroconducting media using helically traveling (in particular, rotating and axially traveling) magnetic fields excited by m-phase systems of helical currents that periodically change in time either harmonically or anharmonically, in which the currents are cophasally or synchronously multiplied and hierarchically frequency- and amplitude-modulated by temporally periodic functions.

It is yet another object of the invention that, at a certain choice of currents, modulation amplitudes, frequencies, and the amplitudes of non-stationary components of the EMBF are increased dozens of times in comparison with stationary and non-stationary EMBF components excited by non-modulated magnetic fields. The wave packet of EMBF comprises more frequency components, and as a result, the electromagnetic response of the medium can be highly nonlinear. The influence of such force fields upon liquid media results in a rapid and profound homogenization of their temperature and concentration. The method is more advantageous with respect to energy efficiency than conventional ones and can be realized using standard electrical systems intended for the excitation of such fields.

DETAILED DESCRIPTION OF THE INVENTION

Introduction

Included herein is a method for speeding up of technological processes and for improving the quality of products in metallurgy, foundry, and chemical industry. The method is based on intensification of technological processes, particularly mixing, by applying traveling magnetic fields which follow the pattern of superwaves. This pattern is in accordance with superwaving activity as set forth in the theory advanced in the Irving I. Dardik article "The Great Law of the Universe" that appeared in the March/April (V. 44, No. 5) 1994 issue of the "Cycles" Journal. See, also, the Irving I. Dardik articles "The Law of Waves" that appeared in the Month?/Month? (V. 45, No. 3) 1995 issue of the Cycles Journal and "Superwaves: The Reality that is Existence" that appears on the website www.dardikinstitute.org, 2002. These articles are incorporated herein by reference in their respective entireties.

As pointed out in the Dardik article, it is generally accepted in science that all things in nature are composed of atoms that move around in perpetual motion, the atoms attracting each other when they are a little distance apart and repelling upon being squeezed into one another. In contradistinction, the Dardik hypothesis is that all things in the universe are composed of waves that wave, this activity being referred to as "superwaving." Superwaving gives rise to and is matter in motion (i.e., both change simultaneously to define matter-space-time).

Thus in nature, changes in the frequency and amplitude of a wave are not independent and different from one another, but are concurrently one and the same, representing two different hierarchical levels simultaneously. Any increase in wave frequency at the same time creates a new wave pattern, for all waves incorporate therein smaller waves and varying frequencies, and one cannot exist without the other.

Every wave necessarily incorporates smaller waves, and is contained by larger waves. Thus each high-amplitude low-frequency major wave is modulated by many higher frequency low-amplitude minor waves. Superwaving is an ongoing process of waves waving within one another, preferably sharing a fractile relationship with one another.

Figure 1:
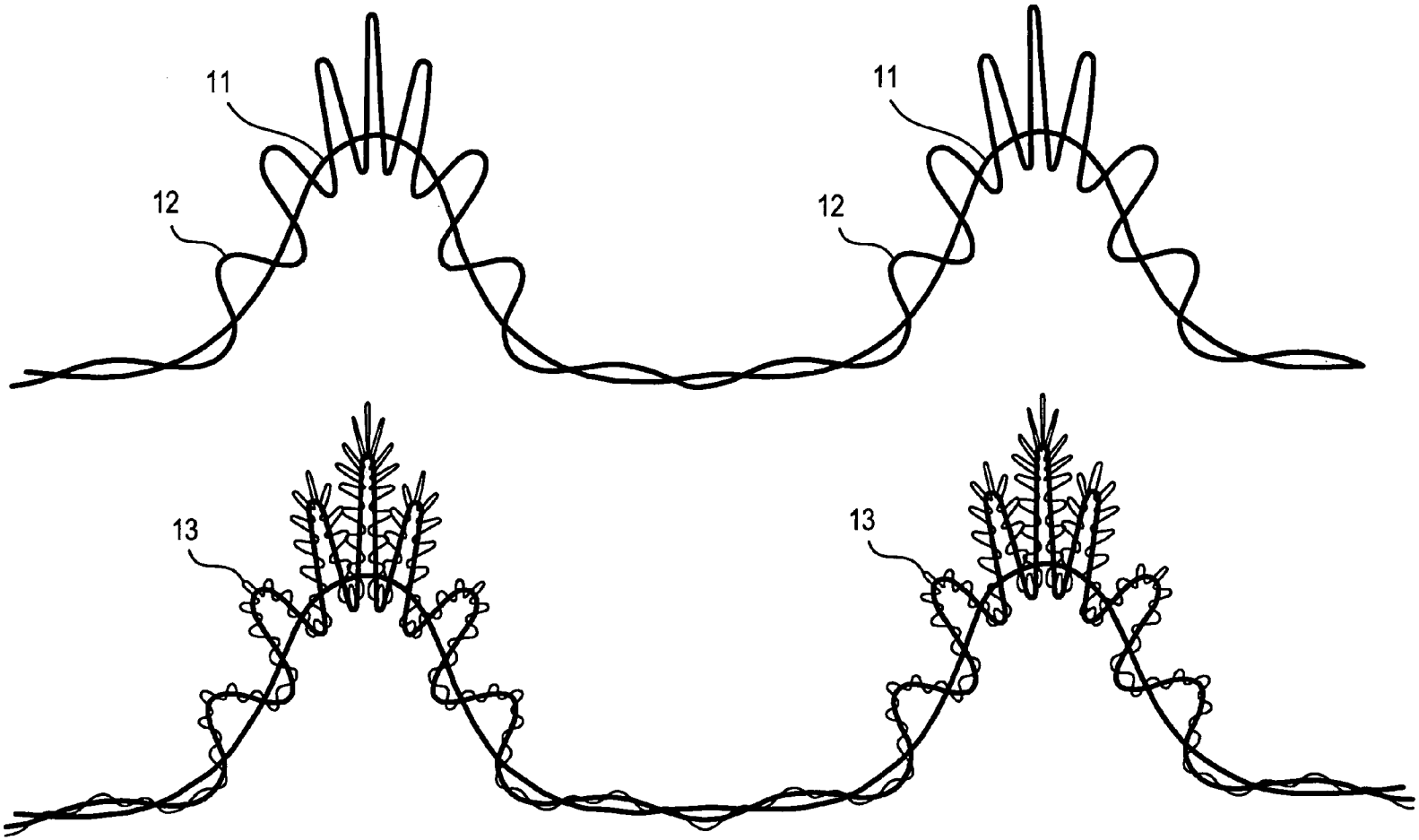
FIGS. 1 and 2 illustrate superwaving wave phenomena.
Figure 2:
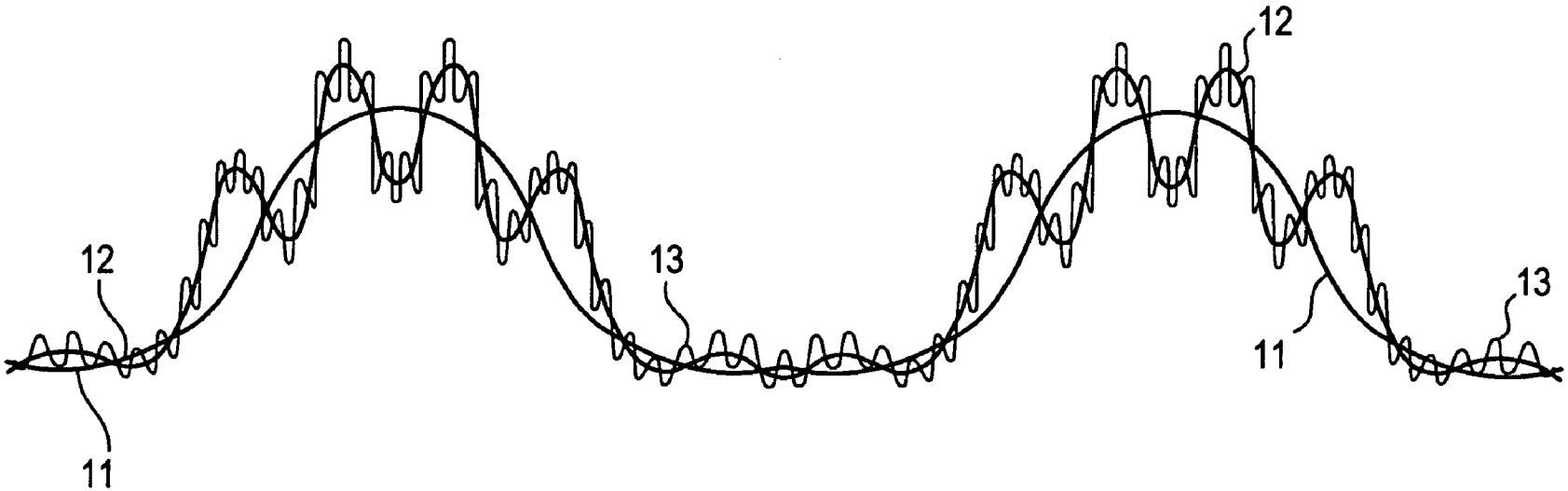

FIG. 1 (adapted from the illustrations in the Dardik article) schematically illustrates superwaving wave phenomena. FIG. 1 depicts low-frequency major wave 11 modulated, for example, by minor waves 12 and 13. Minor waves 12 and 13 have progressively higher frequencies (compared to major wave 11). Other minor waves of even higher frequency may modulate major wave 11, but are not shown for clarity. This same superwaving wave phenomena is depicted in the time-domain in FIG. 2.

This new principle of waves waving demonstrates that wave frequency and wave intensity (amplitude squared) are simultaneous and continuous. The two different kinds of energy (i.e., energy carried by the waves that is proportional to their frequency, and energy proportional to their intensity) are also simultaneous and continuous. Energy therefore is waves waving, or "wave/energy."

This phenomenon can be studied theoretically using equations of electrodynamics and fluid mechanics, as well as a number of empirical findings established in experimental magneto hydrodynamics. Therefore, it is anticipated that the results of studying superwaves in metallurgy, foundry, and chemical industry will advance our understanding of superwave phenomena in general.

Metallurgy, foundry and chemical industry are among the most energy-consuming branches of industry in developed countries. Thus, for instance, electric energy consumption at the production of alloyed steels in arc furnaces amounts to about 400-500 kW-h/ton (it is to be understood that these numbers relate only to the steel production process and do not include electric energy consumption for cast iron production and steel rolling). The electric energy consumed for the production of one ton of magnesium alloys in electric resistance furnaces and for the production of one ton of copper alloys in channel induction furnaces is also close to about 400 kW-h.

The intensive mixing of the molten metal during casting is vital for the production of high-quality steel. As described below, the introduction of mixing forces by means of nonlinear superwaves with amplitude and frequency modulation intensifies mixing and, at the same time, also decreases significantly the electric energy consumption and, hence, increases considerably the economic efficiency.

The following simple calculation can give a general idea about the level of potential savings. The pricing of electric energy in the USA is rather complicated. It is different in different states. It also depends strongly on the peak value of consumed power, and amounts, on the average, to about at least 15 cents/kW-h. Hence, the cost of the above mentioned 400-500 kW-h/ton is $60-75 per ton of metal. The total cost of production of steel sheet and profiled steel is about $300/ton. It follows then that the cost of electric energy consumed for steel production in furnaces, (i.e., the share of the expenses which can be substantially reduced by using superwaves for stirring), is in the range of about 20-25% of the total metallurgical product cost.

The productivity of metallurgical and chemical plants producing and treating melts or electrolyte solutions is determined by the rate of the processes of melting or dissolution of reagents added to a melt or a solution and by chemical reaction rates in melts or electrolyte solutions. The rate of the above-mentioned processes depends, other conditions being equal, on the intensity of melts (or solutions) stirring in technological plants. The same factor determines the structure of a melt in the process of its crystallization, and the production of continuous and stationary ingots and castings, and, hence, their mechanical properties. The intensity of melts and solutions stirring is the principal factor determining the productivity of metallurgical and chemical plants, energy consumption for the production of metal articles and various chemical substances, and their quality.

Therefore, the attention paid to stirring intensification in metallurgy, foundry, and chemical industry appears to be quite natural. Estimations of the mean velocity of a turbulent rotating MHD flow show that the velocity is proportional to the square root of the magnitude of the electromagnetic body force, which, in turn, is proportional to the slip, (i.e., to the difference $\omega/p-\Omega$: where $\omega/p$ is the angular velocity of RMF rotation, p is the number of pole pairs, and $\Omega$ is the angular velocity of melt rotation). Thus, mean angular velocity of the rotation of the turbulent flow quasi-solid core is determined by the following simple expression from the E. Golbraikh, A. Kapusta, and B. Mikhailovich presentation "Semiempirical Model of Turbulent Rotating MHD Flows" at the Proc. 5th Internal. PAMIR Conf., Ramatuelle, France, Sep. 16-20, 2002,I-227-I-230 (which is also incorporated by reference herein in its entirety):

$$\Omega \approx (Q/2)(\sqrt{1+4/Q}-1)\omega, \quad (2)$$

where $Q=Ha^2\cdot\delta_z/Re_\omega\cdot C_0$; here $Ha=B_0R_0\sqrt{\sigma/\eta}$; $\delta_z=Z_0/R_0$; $Z_0$ is the melt height; $R_0$ is the radius of the container with melt; $Re_\omega=\omega R_0^2/\nu$; $\nu$ is the kinematic viscosity of the melt; $\sigma$ is melt electrical conductivity; and $C_0=0.018$ is an empirical constant.

Estimation of the Effect of Superwave-Modulated Magnetic Fields in Steel Production:

The time required for a complete homogenization of the melt or electrolyte solution temperature, and composition at their turbulent stirring is inversely proportional to the angular velocity of the fluid rotation. Hence, with an approximately 1.5-fold increase in the rotation velocity, the homogenization time is decreased by the same ratio. Since the homogenization time accounts for about 50% of the total casting time, this allows for about a 20% reduction of melting duration in electric furnaces, and approximately 50% acceleration of desulfurization and dephosphorization reactions in MHD facilities for out-of-furnace treatment.

Since the power of stirring MHD facilities generally amounts to about 1-1.5% of the furnace transformer power, the reduction of the melting duration leads to an extremely significant electric energy saving. A 1.5-fold decrease in melting duration in arc furnaces reduces the specific electric energy consumption down to about 270-330 kW h/ton, (i.e., the specific-electric energy saving will amount to about 130-170 kW h/ton, and thus $20-26/ton).

Estimation of the Effect of Superwave-Modulated Magnetic Fields Application in the Process of Ingots (Castings) Crystallization:

As demonstrated by Pestel et al. U.S. Pat. No. 2,963,758, which is hereby incorporated by reference herein in its entirety, the optimal crystalline structure of a steel ingot may be obtained under the following condition:

$$\omega B^2R^2 \approx 5\times10^{-3}-11.3\times10^{-3}\ T^2m^2/s \quad (3),$$

where $\omega$ is the angular velocity of the magnetic field rotation, rad/s; B is magnetic induction, T; and R is the liquid crater radius, m. Hence, the necessary value of the magnetic induction is:

$$B\sim0.04-0.06T. \quad (4)$$

Inductors installed at continuous casting facilities ("CCF") generate a magnetic field in the melt. The rotating (traveling) magnetic field induces currents, whose interaction with said field results in the appearance of electromagnetic forces affecting the melt. The nominal power of the inductors amounts to about 150-300 kW at a specific electric energy consumption, (i.e., about 10-12 kWh/ton), depending on the CCF type and productivity. When using amplitude and frequency modulated currents, at a comparable power of the inductors, the ingot crystallization process is considerably accelerated, which increases CCF productivity. Besides, strength characteristics of the cast metal are improved and its porosity decreases.

Furthermore, as preliminary experiments have shown, when using amplitude- and frequency-modulated currents, the character of force impact of the electromagnetic field on the melt is considerably changed, because side by side EMBF with an increase in the mean EMBF value (which increases the mean flow rate) involves powerful pulses causing melt vibration. The combined action of these factors leads to a significant improvement of a continuous ingot quality.

On the Potential Use of Superwave-Modulated Magnetic Fields in Chemical Technology:

In chemical industry, stirring is performed in order to intensify heat and mass exchange and to accelerate chemical reactions. To stir liquids, as a rule, turbine-type and impeller mixers are applied. In this case, leveling of the concentration and temperature of phases to be mixed is accomplished due to circulation and turbulent diffusion. An approximate calculation of the total homogenization time $\tau$ in plants with mechanical stirrers in a turbulent mode is performed using the following formula, which may be found in Tatterson, G. B., Calabrese, R. V., and Penney, W. R. 1994. Industrial Mixing Technology: Chemical and Biological Application. AI Chem. Engng. Publ., which is hereby incorporated by reference herein in its entirety:

$$\tau \approx 5V/nd^3, \quad (5)$$

where V is the apparatus volume in $m^3$; n is the number of the stirrer revolutions; and d is its diameter.

The dependence of dimensionless EMBF on the relative frequency, where $\overline{\omega}=\mu_0\sigma\omega R_0^2$, shows that for very low $\overline{\omega}$ values, EMBF is negligibly small.

The magnitude of $\overline{\omega}$ for strong electrolyte solutions in a vessel 1 m in diameter affected by a RMF with the frequency $\omega$=314 rad/s amounts to about 0.001. The relative EMBF value over the radius of 0.4 m equals $f=\overline{\omega}\ r/2\sim0.0002$. Therefore, when an electrolyte (e.g., sulphuric acid) is placed into a sufficiently strong RMF with the induction of about 0.07 T, no rotation is observed and, hence, RMF excited by low-frequency currents does not practically affect electrolyte solutions. However, if a rotating field of current density is conductively introduced into the electrolyte, the interaction of this field with RMF can excite a sufficiently strong EMBF field rotating the electrolyte at a high angular-velocity. RMF and current density field modulation considerably increase the efficiency of the electromagnetic stirring device, which can be advantageously used in chemical industry instead of conventionally applied mechanical agitators when producing such aggressive substances as concentrated acids and alkalis.

Physical Mechanism of the Force Impact of Frequency and Amplitude Superwave-Modulated Magnetic Fields:

Force impact of non-modulated RMF excited by a permanent magnet rotating at a constant angular velocity around the axis of a vessel with conducting fluid will now be described. A magnetic field B rotating at the same angular velocity with respect to motionless liquid excites axial currents rotating at the same velocity in the conducting fluid. The interaction of induced currents with the magnetic field generates EMBF aligned with the magnet rotation. These forces have a stationary component and a non-stationary component, which periodically varies with a double frequency $2\omega$ and an amplitude equal to that of the stationary component. Under the action of these forces, the fluid starts rotating at a certain angular velocity $\Omega<\omega$, since the density of induced currents is proportional to the slip—$(\omega-\Omega)$ difference.

If the angular velocity of the magnet is non-stationary, (i.e., it periodically varies with time), this additional motion induces additional currents whose interaction with the modulated magnetic field generates additional forces acting upon the fluid. As a result of such an impact, the mean angular velocity of the fluid rotation grows, and a two-dimensional vibration arises, which actively stirs the fluid. Naturally, if the angular velocity of the magnet rotation is non-stationary, a certain amount of additional work is necessary to accomplish its rotation at the same principal angular velocity $\omega$.

The proposed method is realized as follows.

The form into which the melt is poured is placed into a non-magnetic clearance of an m-phase inductor, into whose coils currents modulated by said method are applied. The currents generate in the melt helically traveling (in particular, rotating and axially traveling) frequency- and amplitude-modulated magnetic fields, which, in turn, induce an m-phase system of currents modulated by said method in the melt.

As a result of the interaction of said currents with the magnetic field, in a general case, a three-dimensional EMBF field arises. Each component of this field comprises a steady component and a complicated set of pulsations and oscillations with various amplitudes, frequencies and initial phases.

Figure 3:
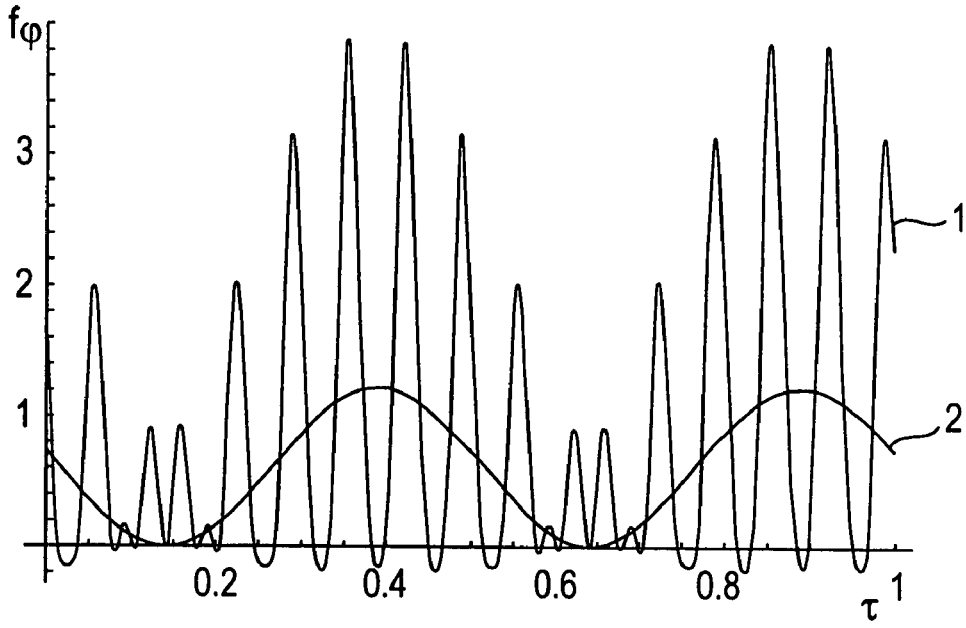
FIG. 3 shows a dependence of the amplitude of dimensionless frequency- and amplitude-modulated EMBF on dimensionless time (the following values merely describe an exemplary embodiment of the chart described in the figure: $\omega_1=1$; $\omega_2=7$; $\epsilon_1=0.1$; $\epsilon_2=0.6$; $r=0.5$; $p=1$; $\gamma=0$): curve 1 corresponds to frequency- and amplitude-modulated RMF; and curve 2 corresponds to non-modulated RMF.
Figure 4:
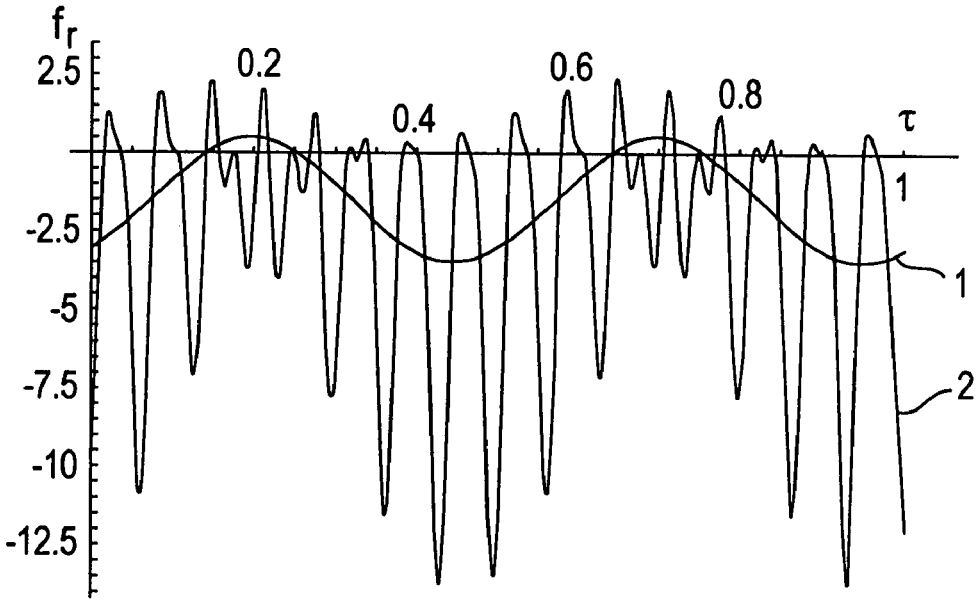
FIG. 4 shows a dependence of the amplitude of dimensionless EMBF on dimensionless time in the absence of modulation (the following values merely describe an exemplary embodiment of the chart described in the figure: $r=0.5$; $p=1$): curve 1 corresponds to frequency- and amplitude-modulated RMF; and curve 2 corresponds to non-modulated RMF.

The dependence of the amplitude of the azimuthal component of dimensionless EMBF on dimensionless time is presented in FIG. 3: 1—excited by amplitude- and frequency-modulated currents; and 2—in the absence of modulation. The dependence of the radial component of the amplitude of dimensionless EMBF on dimensionless time is presented in FIG. 4: 1—excited by amplitude- and frequency-modulated currents; and 2—in the absence of modulation.

Under the action of the EMBF field, a turbulent flow with a complicated spatial structure and forced oscillations with frequencies depending on the EMBF field frequency spectrum is maintained in the melt and, naturally, in the vicinity of the crystallization front. Such a flow, according to the invention, may totally suppress the growth of columnar crystals, and the ingot (casting) solidifying under such conditions, preferably, has an equiaxial, fine-grained dense structure.

Figure 4A:
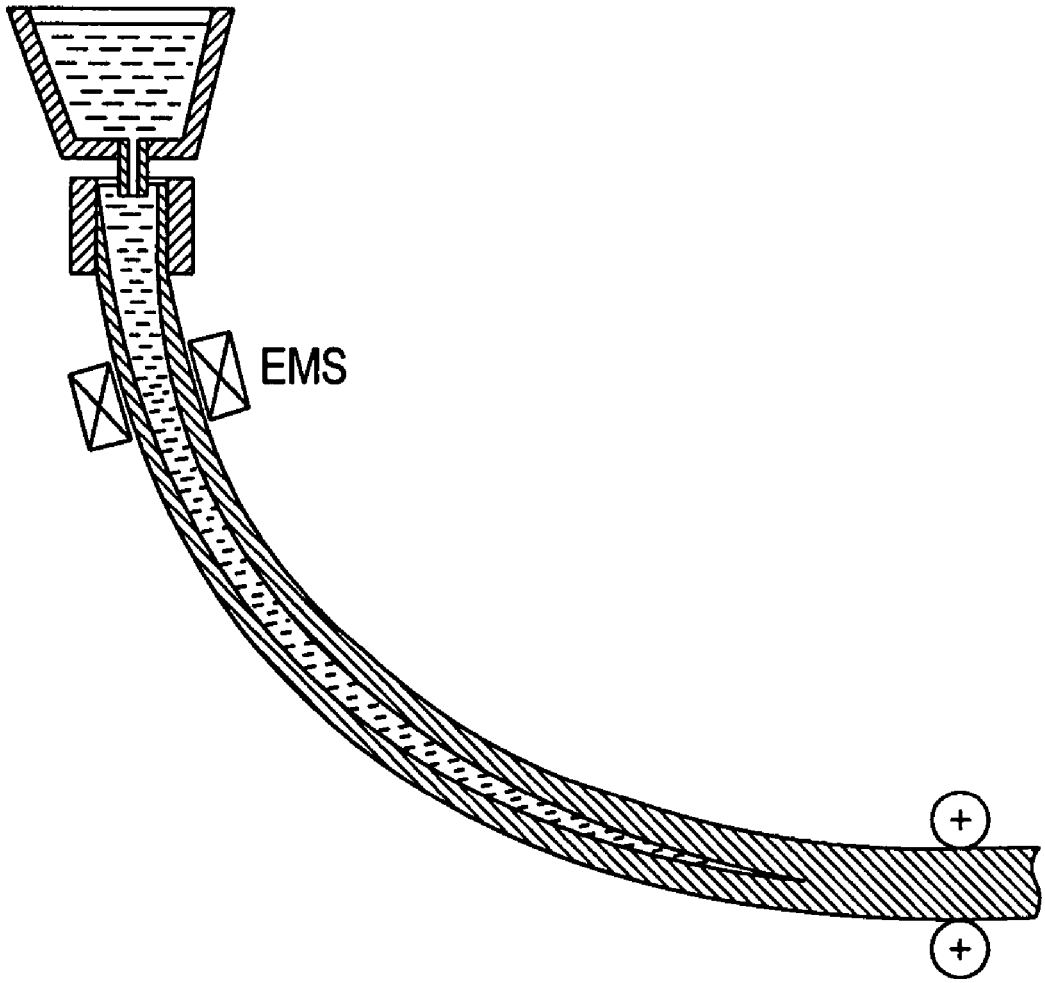
FIG. 4A is a side section view of a furnace according to the invention.

In continuous casting plants, the m-phase inductor can be placed below the crystallizer (see FIG. 4A) (in case of steel casting) or built into the crystallizer. In preferred embodiments of the invention, the casting mold should be made from a material that screens the magnetic field to a minimal extent.

Figure 5:
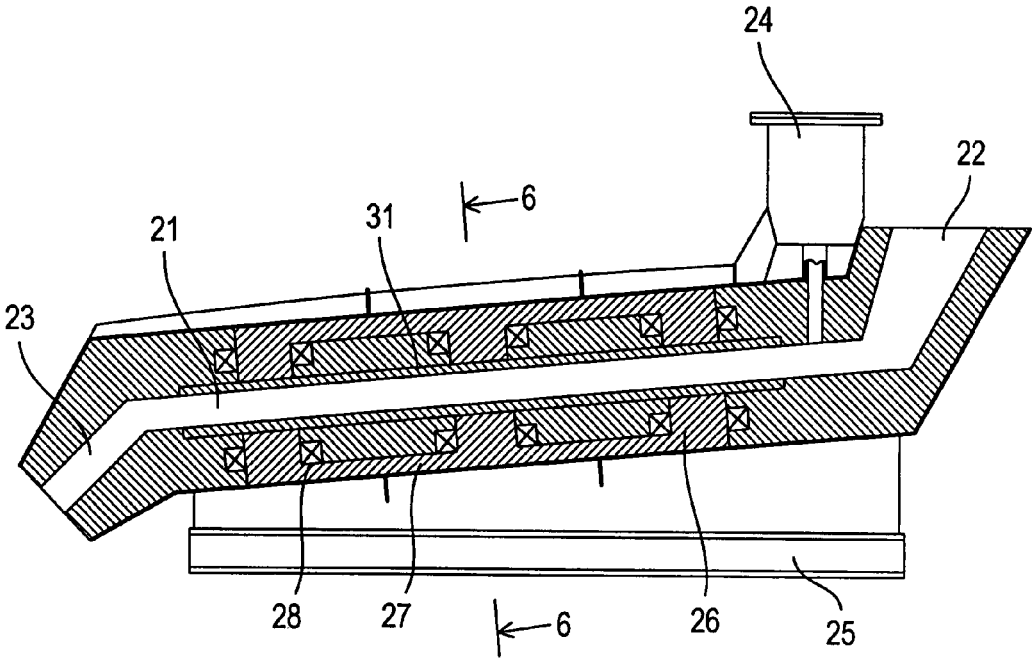
FIG. 5 is the vertical longitudinal section of a first version of a magnetohydrodynamic facility for continuous refining or alloying of ferrous metals.
Figure 6:
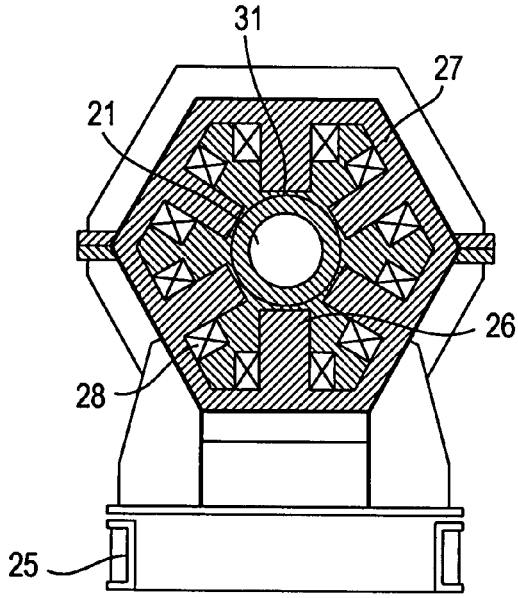
FIG. 6 is the vertical transverse section of the first version of the MHD facility for continuous fining or alloying of ferrous metals of FIG. 5, taken from line 6-6 of FIG. 5.

The proposed facility, shown in FIGS. 5 and 6, comprises lined channel 21 with receiving funnel 22, ladle lip 23, hopper 24 for reagents, and frame 25. An inductor with magnetic circuit 27 made of ferroceramics and coils 28 (see, e.g., FIGS. 9 and 10) in the form of ceramic boxes with helical channel 29 filled with liquid metal, whose melting temperature is much below the melting temperature of the melt to be treated, and whose boiling temperature is much higher than that of the melt to be treated (tin can be used as such a metal, for example), are arranged inside the channel lining. Electrodes 30, one of which is tubular and another of which is solid, serve to supply an electric current into the coil and to pour metal into channel 29.

Figure 7:
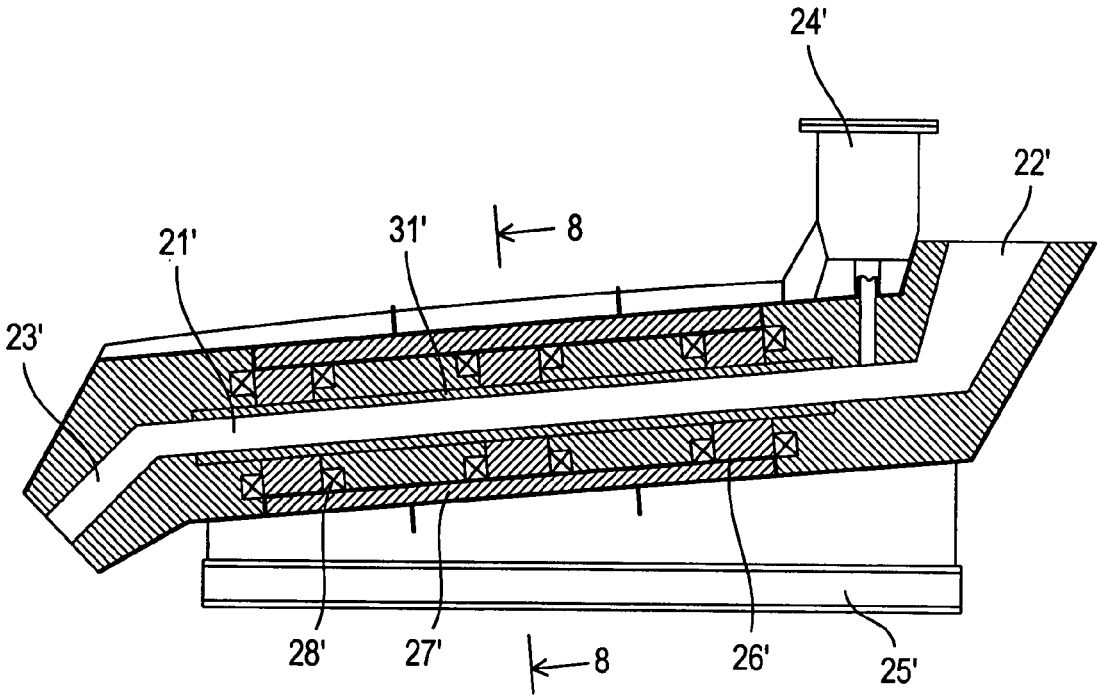
FIG. 7 is the vertical longitudinal section of a second version of a MHD facility for continuous fining or alloying of ferrous metals, wherein the back of the magnetic circuit may be made of laminated electrotechnical steel.
Figure 8:
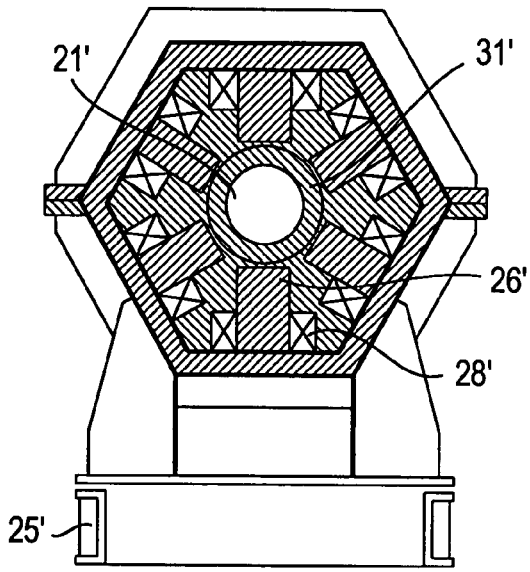
FIG. 8 is the vertical transverse section of the second version of the MHD facility for continuous fining or alloying of ferrous metals of FIG. 7, taken from line 8-8 of FIG. 7.

FIGS. 7 and 8 show the second version of the facility design comprising lined channel 21', wherein poles 26' made of ferroceramics are arranged in the furnace lining, and back 27' of the magnetic circuit is made of laminated electrotechnical steel sheet and fixed in an annular groove on shaft jacket 23'. Poles 26' of the magnetic circuit are protected from the melt by ceramic pipe 31', whose thickness is chosen so that the temperature on the external surface of the pipe preferably does not exceed the Curie temperature of ferroceramics.

The proposed facility operates as follows. Liquid metal may be supplied into funnel 22 from a ladle, blast-furnace, or cupola-furnace. The necessary reagent is continuously supplied from hopper 24. The melt flows through channel 21, in which it is affected by EMBF according to the invention, which mix the melt intensely with the reagent. The treated melt is continuously discharged into the ladle. At the melt refinement with certain reagents (soda, lime or Mg powder), the latter are also molten and form slag enriched with detrimental impurities, which is removed from the melt before metal discharge from the ladle.

Thus, there is provided a method of continuous out-of-furnace alloying or purification of ferrous metal melts from detrimental impurities under the action of helically traveling (i.e., traveling in a screw-like movement such that the melt is rotating, while axially traveling along the longitudinal axis of channel 21) magnetic fields excited by m-phase systems of amplitude- and frequency-modulated currents, wherein the amplitude modulation depth and frequency modulation deviation vary along the axis of a long lined pipe. Estimations have shown that in this case, peak values of the electromagnetic body forces can be higher than in the absence of modulation, which ensures an intense melt stirring, reduces the time required for a total homogenization of its temperature and composition, and considerably accelerates the dissolution of alloying additives and the rate of chemical reactions discharging detrimental impurities into slag. The design of a facility realizing said method for high-temperature melts is also provided.

Yet another proposed method according to the invention relates to intensification of melting and melt stirring processes. The-method of the present invention allows a considerable increase in the melt stirring intensity in the furnace shaft, reduction of melting time, and improvement of the quality of metals and alloys due to the intensification of the reactions at the metal-slag boundary. Furthermore, the method allows an increase in the capacity of channel induction furnaces at the expense of increasing the shaft height without increasing the power of the furnace transformer.

A considerable reduction of melting time (e.g., by 20%) will significantly reduce energy consumption of the process of producing metals and alloys in channel induction furnaces, despite the additional energy expenditure for RMF excitation. As a rule, present-day arc furnaces are equipped with arc stators produced by a Swedish company, ASEA, which are installed under the furnace bottom. Stator windings are fed by currents with a frequency of about 0.35-1.50 Hz, depending on the furnace capacity. Stator power usually amounts to about 2% of the furnace transformer power and can reach up to about 0.5 MVA for large-volume furnaces.

The proposed method of the present invention of melting and melt stirring intensification in electric-arc furnaces combined with a novel design of an RMF inductor make it possible to reduce electric energy consumption for melt stirring and to significantly intensify the process of melting, which, in turn, leads to a reduction of melting time, increase in the furnace output, reduction of the consumed electric energy, and reduction of metal waste.

The design of the RMF inductor significantly differs from the known ones used in metallurgy and foundry. For this purpose, a method of the present invention makes the magnetic circuit of the inductor from so-called ferroceramics representing a refractory material (e.g., chamotte, magnesite, chromomagnesite, or high-temperature concrete) with a filler representing iron or cobalt powder. The powder particle size may be 1 mm, for example, and the powder content in the refractory material may depend on the type of the refractory material used. After thorough stirring, such a material is produced in the form of individual elements with its shape depending on the design of a specific furnace, and then the material is baked. Up to the Curie temperature of the filler, the material retains its magnetic properties, is not electroconducting, has a sufficiently low thermal conductivity, and can be used simultaneously as both the magnetic circuit inductor and the lining of the facility. Such a design of an RMF inductor makes it possible to arrange the RMF source maximally close to the melt and to reduce the required inductor power. Furthermore, such a design significantly reduces the magnitude of non-magnetic gap between the liquid metal and the inductor and excludes magnetic field weakening by the furnace jacket. Because the inductor coils are also located in the high-temperature zone, their design also greatly differs from inductor coils conventionally applied in metallurgical technology.

The proposed method of the present invention of intensification of technological processes in channel induction furnaces and alterations introduced into their design make a considerable contribution to the improvement of the technological plants.

By way of example, the figures show the design of a one-phase one-channel induction furnace with the proposed structural changes providing for the above-described advantages of the present invention.

Figure 10:
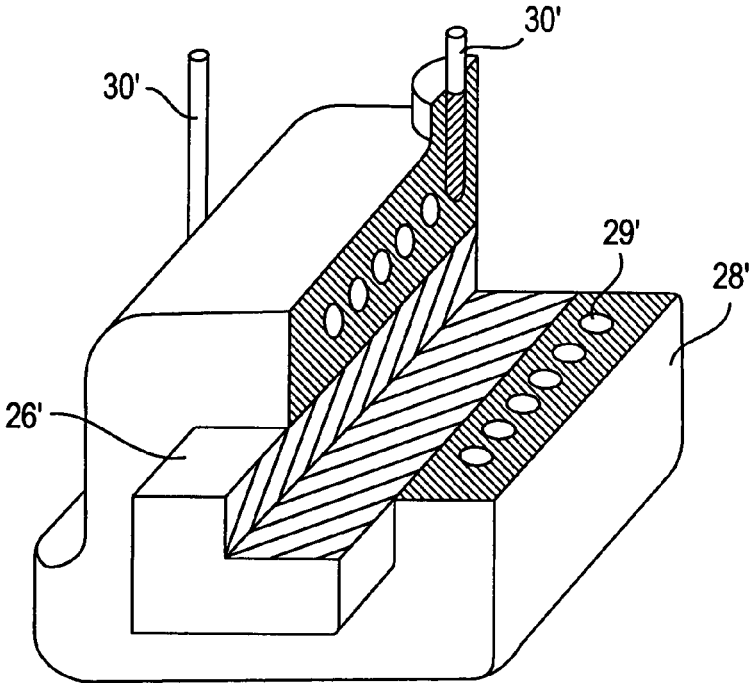
FIG. 10 is the second version of the design of the inductor coil of the facility shown in FIGS. 7 and 8, shown in isometric projection with a cut-off quarter.
Figure 11:
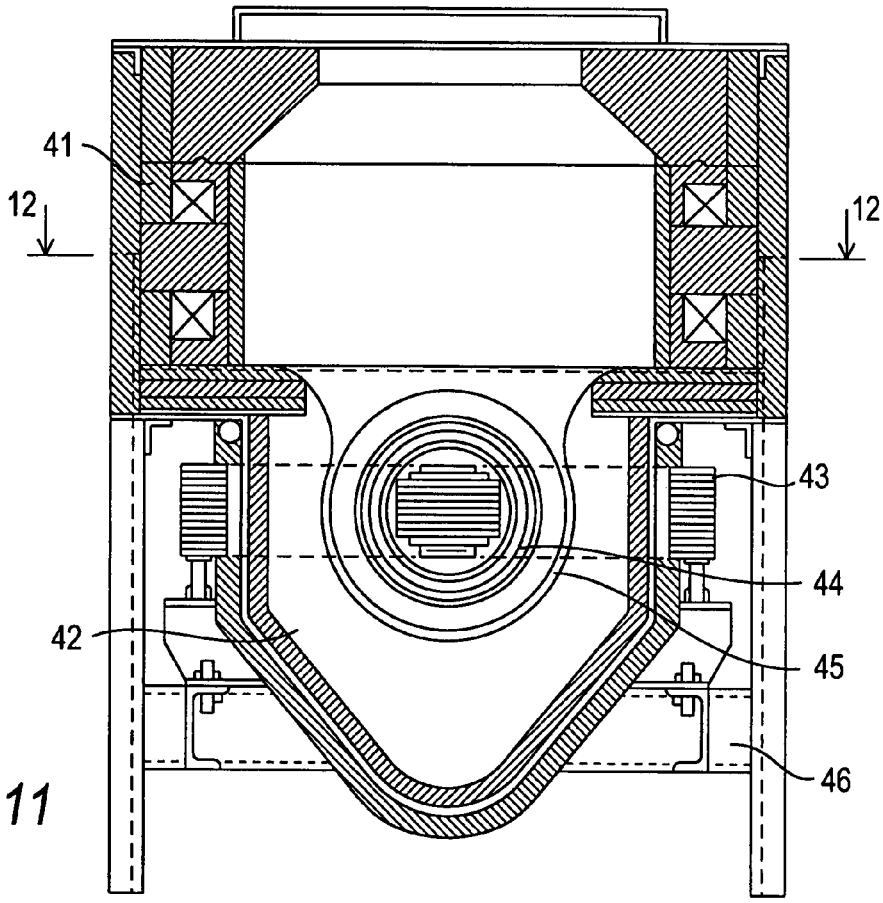
FIG. 11 is the vertical section of a one-phase one-channel induction furnace with a first embodiment of an inductor exciting RMF.
Figure 12:
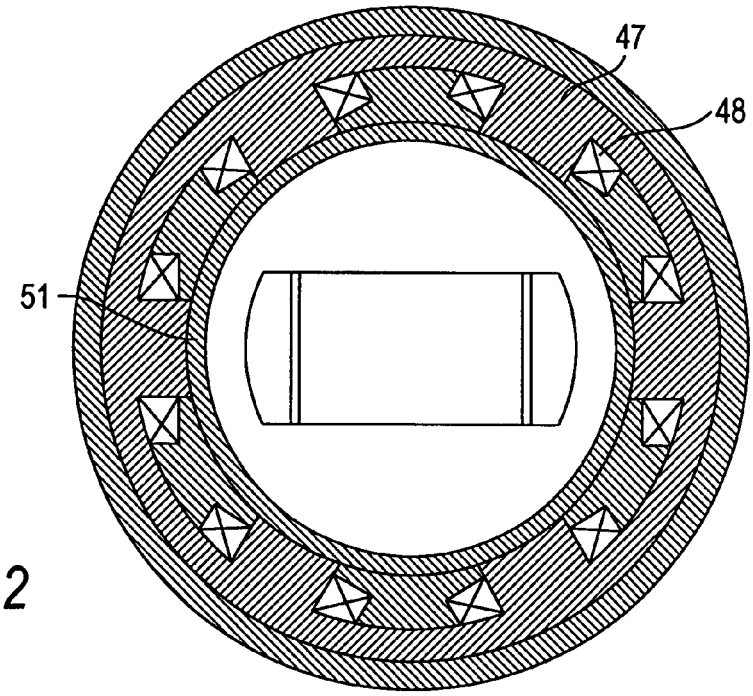
FIG. 12 is the horizontal section of the one-phase one-channel induction furnace with the first embodiment of the inductor exciting RMF of FIG. 11, taken from line 12-12 of FIG. 11.

FIGS. 11 and 12 show vertical and horizontal sections of a first embodiment of a furnace of the present invention. The furnace comprises lined shaft 41, channel section 42, furnace transformer 43, primary winding 44 of the transformer, channel 45, and frame 46. Magnetic circuit 47 made of ferroceramic elements is built into the lining of shaft 41. Coils 48, which are made in the form of ceramic boxes with a helical channel (see, e.g., channel 29, FIGS. 9 and 10) are attached on the poles of shaft 41. Channel 29 is filled with liquid metal, whose melting temperature is much lower than the temperature of the melt in the furnace, and whose boiling temperature is much higher than that of the melt (tin can be used as such a metal, for example).

Figure 9:
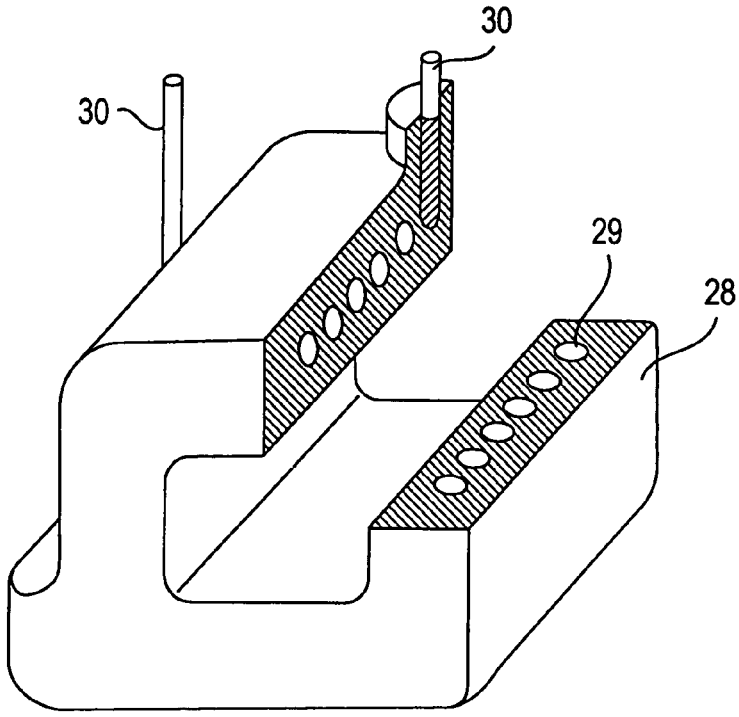
FIG. 9 is the first version of the design of the inductor coil of the facility of FIGS. 5 and 6, shown in isometric projection with a cut-off quarter.

In the back part of coil 48, which has a comparatively low temperature, solid electrodes 30 in FIG. 9 are introduced, one of which is tubular and another of which is solid, through which an electric current is applied to the liquid-metal winding, and the metal is poured into channel 29. The poles of magnetic circuit 47 are separated from the melt by lining layer 51, whose thickness is chosen in such a way that the temperature on the external surface of layer 51 is lower than the Curie temperature of ferroceramics.

Figure 13:
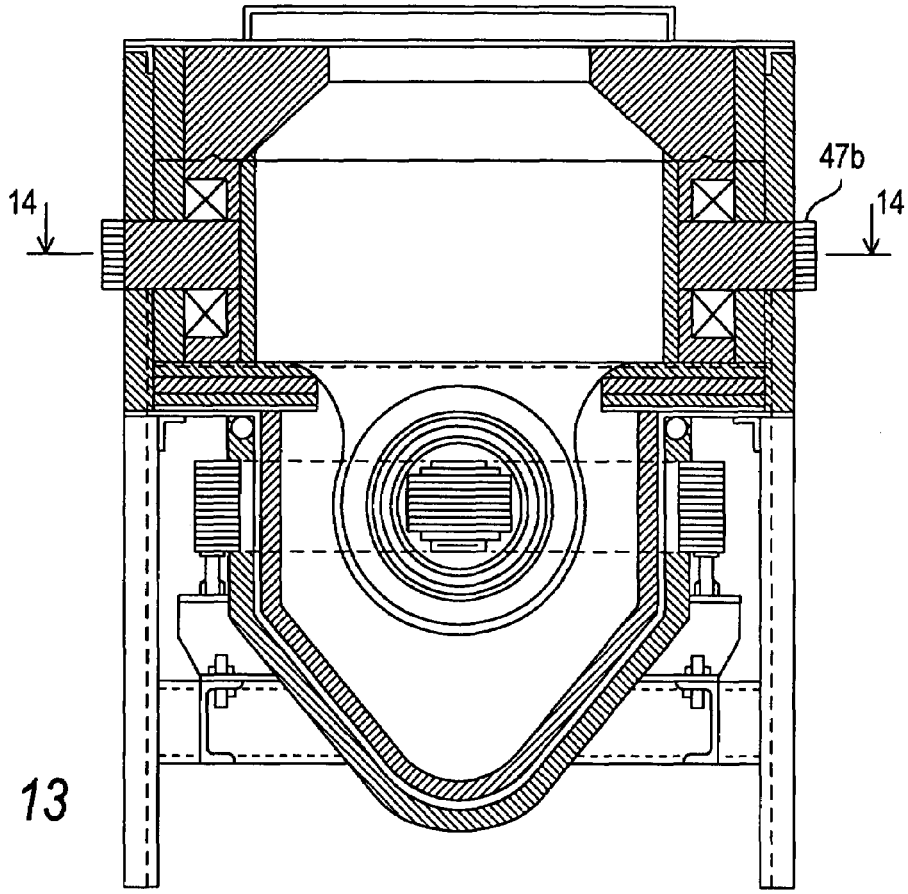
FIG. 13 is the vertical section of a one-phase one-channel induction furnace with a second embodiment of an inductor exciting RMF.
Figure 14:
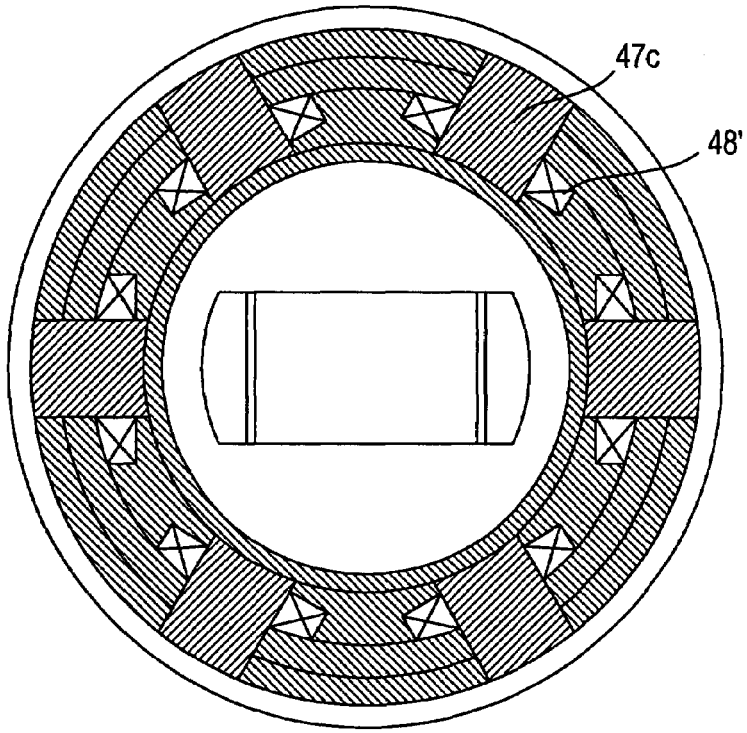
FIG. 14 is the horizontal section of the one-phase one-channel induction furnace with the second embodiment of the inductor exciting RMF of FIG. 13, taken from line 14-14 of FIG. 13.

FIGS. 13 and 14 show a second embodiment of a furnace of the present invention, wherein poles 47*c* made of ferroceramics with coils 48' are arranged in the furnace lining, and back 47*b* of the magnetic circuit of the RMF inductor is made of laminated transformer steel and fixed to the shaft jacket.

Figure 15:
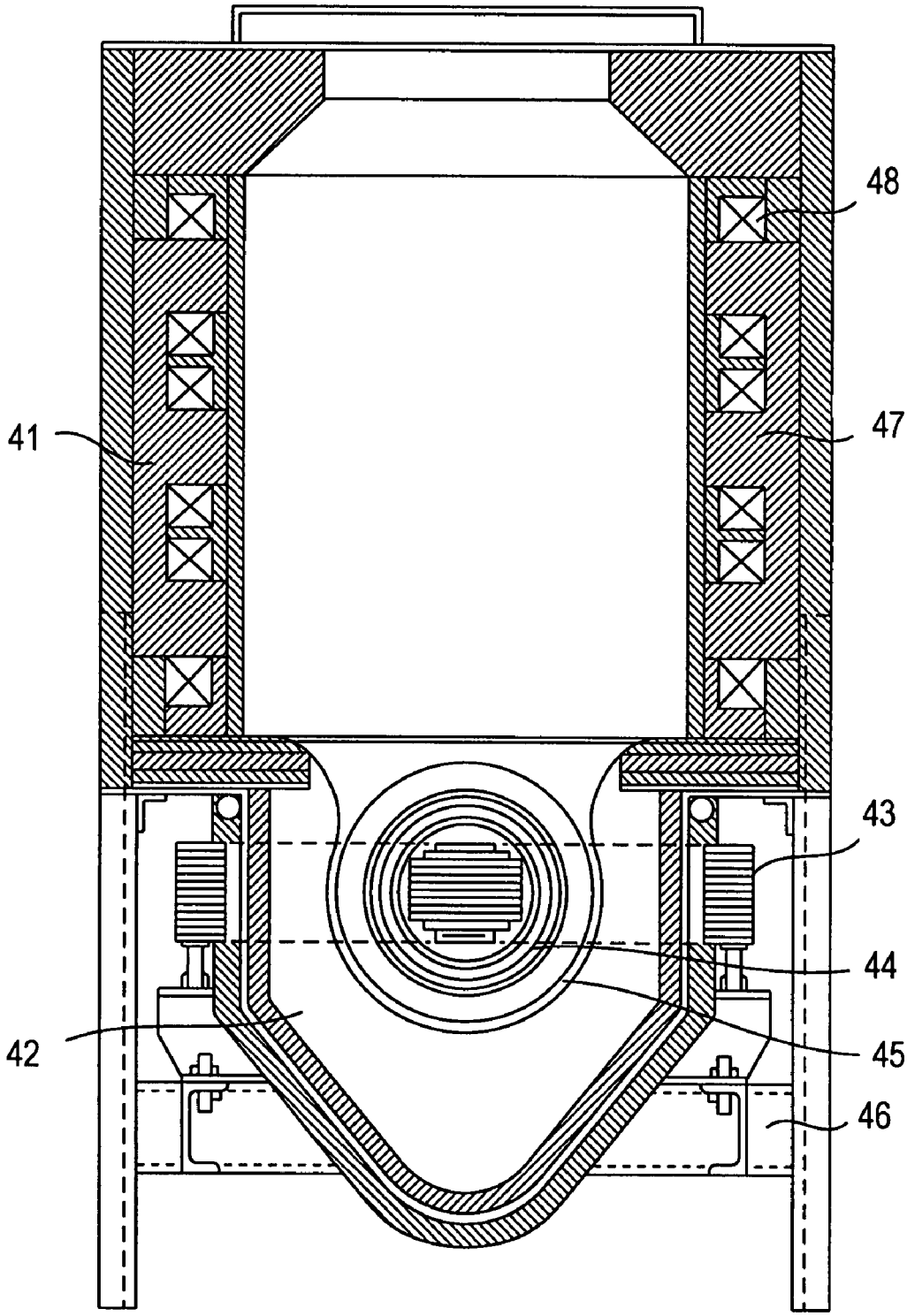
FIG. 15 is the vertical section of the one-phase one-channel induction furnace of FIG. 11, with an extended shaft and a three-phase inductor for exciting a helically traveling magnetic field.

FIG. 15 shows the first embodiment of a furnace of the present invention shown in FIGS. 11 and 12 with an extended shaft and a three-phase inductor. Depending on the alteration of phases in the coils arranged in vertical and horizontal planes, such an inductor can excite a helical magnetic field, RMF, or magnetic field traveling along the furnace axis. At an amplitude and frequency modulation of such fields, both mean velocities of helical, rotary, or vertical flows, respectively, and pulsating velocity components ensuring a forced highly-intense turbulent spectrum of melt oscillations grow considerably (preferably, by at least an order of magnitude). As a result, melting time in furnaces of a sufficiently large volume will be reduced (e.g., by 20%).

At the modulation of currents feeding the primary windings of the furnace transformer, currents in the channel may also be frequency- and amplitude-modulated. The interaction of such currents with an intrinsic magnetic field lead to the appearance of an additional vortical non-stationary EMBF field, which turbulizes the flow in channels and intensifies thermal exchange with the metal in the shaft. Furthermore, the release of Joule heat in the channels also grows at the expense of a certain increase in the furnace transformer power.

Figure 16:
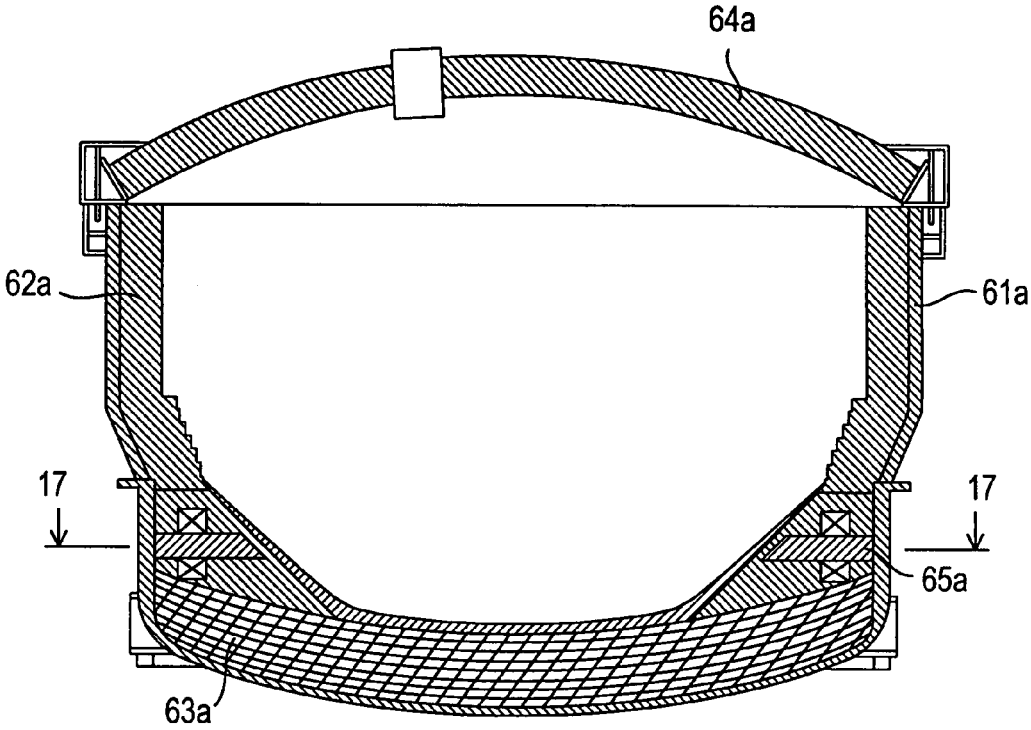
FIG. 16 is the vertical section of a high-capacity melting chamber of an electric-arc furnace with an RMF inductor.
Figure 17:
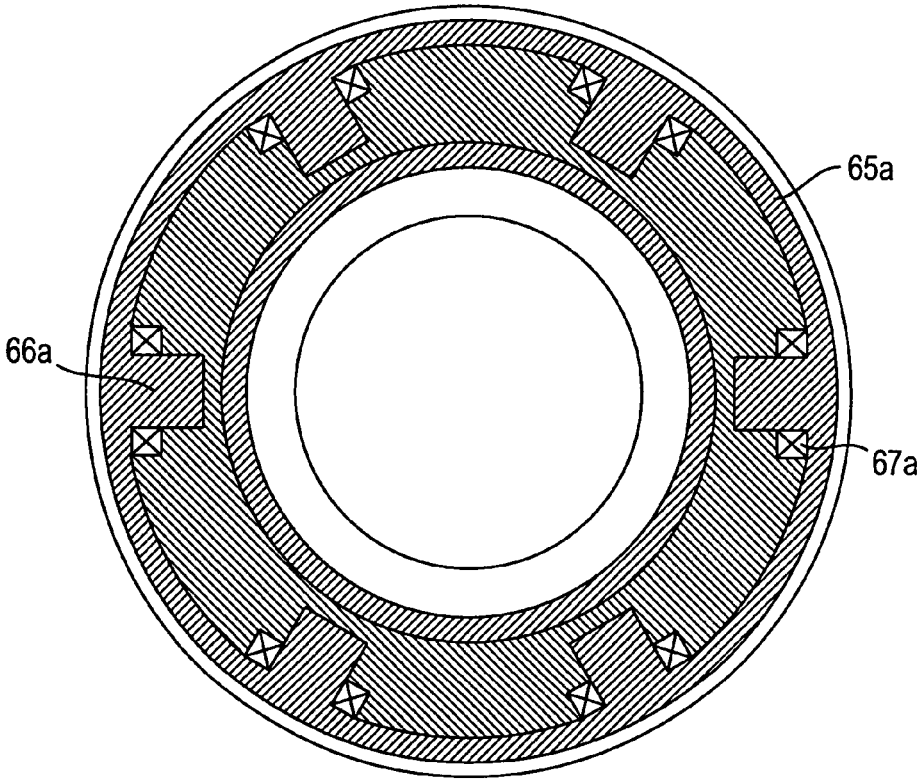
FIG. 17 is the horizontal section of the high-capacity melting chamber of an electric-arc furnace with an RMF inductor of FIG. 16, taken from line 17-17 of FIG. 16.

FIGS. 16 and 17 show a high-capacity (e.g., 200 ton capacity) melting chamber of an electric-arc furnace of the present invention comprising steel jacket 61*a*, cylindrical part lining 62*a*, floor lining 63*a*, and roof 64*a*. An m-phase RMF inductor with backs 65*a* and poles 66*a* made of ferroceramics with cobalt filler is embedded into floor lining 63*a*. The Curie temperature of the ceramics may be 1000° C., for example. The design of coils 67*a* may be identical to that of coils 28 (FIG. 9) for the above-described channel furnace inductors. Since the ferroceramics have a low thermal conductivity, while the coils may operate at a temperature in the range of 300-400° C., for example, the poles of the inductor may be located maximally close to the melt, making it possible to considerably decrease the inductor power and to use frequency- and amplitude-modulated currents.

A method of forcing influence on electroconducting media using helically traveling (in particular, rotating and axially traveling) magnetic fields excited by m-phase systems of helical (in particular, axial or, in other terms, azimuthal) currents that periodically change in time either harmonically or anharmonically, in which the currents are cophasally or synchronously, multiply and hierarchically frequency- and amplitude-modulated by temporally periodic functions, is also provided. At a certain choice of current modulation amplitudes and frequencies, the amplitudes of non-stationary components of the EMBFs are increased preferably dozens of times in comparison with stationary and non-stationary EMBF components excited by non-modulated magnetic fields. The wave packet of EMBF comprises more frequency components, and as a result, the electromagnetic response of the medium can be highly nonlinear. The influence of such force fields upon liquid media results in a rapid and profound homogenization of their temperature and concentration. The method is energetically more advantageous than the known ones and can be realized using standard electrical systems used for the excitation of such fields.

The proposed method of forcing influence increases stirring efficiency by an order of magnitude and, hence, ensures a more profound and rapid homogenization of the melt. By way of example, electrodynamic processes in an electrically conducting cylinder under the action of said amplitude- and frequency-modulated RMF are mathematically examined as follows.

It is convenient to describe such processes in a cylindrical system of coordinates r, ϕ, z using a vectorial potential of magnetic induction connected with the induction by the ratio B=rotA. In this case, the axial component of the current density is:

$$j_z = -\mu_0\sigma\left(\frac{\partial A_z}{\partial t} + \frac{V_\varphi}{r}\frac{\partial A_z}{\partial \varphi}\right), \tag{6}$$

whereas the radial and azimuthal components of the induction are:

$$B_r = \frac{1}{r}\frac{\partial A_z}{\partial \varphi}; \quad B_\varphi = -\frac{\partial A_z}{\partial r} \tag{7}$$

The azimuthal component of EMBF is determined as:

$$f_\phi = Rej_z \cdot ReB_r, \tag{8}$$

and the radial component is determined as:

$$f_r = -Rej_z \cdot ReB_\phi \tag{9}$$

Re being the real part of a complex variable.

The vectorial potential $A_z$ is described by the equation:

$$\Delta A_z = \mu_0\sigma\left(\frac{\partial A_z}{\partial t} + \frac{V_\varphi}{r}\frac{\partial A_z}{\partial \varphi}\right), \tag{10}$$

where $$\Delta = \frac{\partial^2}{\partial r^2} + \frac{1}{r}\frac{\partial}{\partial r} + \frac{1}{r^2}\frac{\partial^2}{\partial \varphi^2};$$

$V_\phi$ is the medium velocity; $\mu_0=4\pi\ 10^{-7}$ Hn/m is the magnetic permeability of vacuum; σ is the electrical conductivity of the medium; and t is time.

Equation (10) is solved under the boundary condition:

$$\left.\frac{\partial A_z}{\partial r}\right|_{r=R_0} = -\mu_0 NI(1+\varepsilon_2 e^{-i[\omega_2(t)\cdot t-p\varphi]})e^{i(\Omega_0 t-p\varphi)}, \tag{11}$$

where NI is a linear current loading; $\omega_2(t)=\omega_2[1+\epsilon_1 \sin(\omega_1 t+\gamma)]$; and p is the number of pole pairs.

Using characteristic values of the vectorial potential, time, coordinate r and angle ϕ:

$$A_0=\mu_0 NIR_0, T_0=2\pi/\Omega_0, R_0, \phi_0=2\pi,$$

problem (10), (11) becomes dimensionless, and under the condition $V_\phi=0$ acquires the form:

$$\frac{\varpi}{2\pi}\frac{\partial a_z}{\partial \tau} = \Delta a_z; \quad \left.\frac{\partial a_z}{\partial r}\right|_{r=1} = -(1+\varepsilon_2 e^{2\pi i[\varpi_2(\tau)\tau-p\varphi]})e^{2\pi i(\tau-p\varphi)}, \tag{12}$$

where $\overline{\omega}=\mu_0\sigma\Omega_0 R_0^2$ is the relative frequency; $\overline{\omega}_1=\omega_1/\Omega_0$, $\overline{\omega}_2=\omega_2/\Omega_0$, $\overline{\omega}_2(\tau)=\overline{\omega}_2[1+\epsilon_1 \sin 2\pi(\overline{\omega}_1\tau+\gamma)]$, $a_z$ is a z-component of the dimensionless vectorial potential; τ is dimensionless time; and r is hereinafter a dimensionless coordinate.

The solution of problem (12) may be approached in the form of a superposition of RMF with a dimensionless reference frequency=1 and modulated RMF:

$$a_z=a_{z1}+\epsilon_2 a_{z2}. \tag{13}$$

Substituting (13) into (12), we obtain:

$$\frac{\varpi}{2\pi}\frac{\partial a_{zi}}{\partial \tau} = \Delta a_{zi}; \quad i=1,2, \tag{14}$$

$$\left.\frac{\partial a_{z1}}{\partial r}\right|_{r=1} = -e^{2\pi i(\tau-p\varphi)}, \tag{15}$$

$$\left.\frac{\partial a_{z2}}{\partial r}\right|_{r=1} = -e^{2\pi i[\varpi_2(\tau)\tau-p\varphi]}e^{2\pi i(\tau-p\varphi)} = \theta(\tau), \tag{16}$$

The problem (14), (15) has an exact solution:

$$a_{z1} = -\frac{J_p(\chi r)}{\chi J_{p-1}(\chi) - pJ_p(\chi)} \cdot e^{2\pi i(\tau - p\varphi)}, \tag{17}$$

where $\chi = i\sqrt{i\omega}$, $J_p(\chi\tau)$ is the Bessel function of the 1st kind in a complex region.

It is convenient to write $a_{z1}$ in the form:

$$a_{z1} = (a_{11} + ia_{12})(\cos 2\pi\phi_1 + i \sin 2\pi\phi_1), \tag{18}$$

where $\phi_1 = \tau - p\phi$, $a_{ik} = a_{ik}(r)$.

The problem (14), (16) has a semi-analytical solution, and $a_{z2}$ can be written in the form:

$$a_{z2} = (a_{21} + ia_{22})(\cos 2\pi\phi_2 + i \sin 2\pi\phi_2), \tag{19}$$

where $$\phi_2 = (1 + \varpi_2)\tau - 2p\varphi,$$

$$a_{21} = \mathrm{Re}\left[\sum_{n=1}^{\infty} \alpha_{2n}(\tau) J_{2p}(\beta_n r) - \theta \frac{r^{2p}}{2p}\right],$$

$$a_{22} = \mathrm{Im}\left[\sum_{n=1}^{\infty} \alpha_{2n}(\tau) J_{2p}(\beta_n r) - \theta \frac{r^{2p}}{2p}\right],$$

$$\alpha_{2n}(\tau) = \chi_{2n} + C_n^* e^{-\tau},$$

$$C_n^* = \frac{1}{p} \frac{\beta_n J_{2n+1}(\beta_n)}{(\beta_n^2 - 4p^2) J_{2p}^2(\beta_n)},$$

$$\chi_{2n} = \sum_{l=-\infty}^{\infty} k_{2nl} e^{2\pi i l \tau},$$

$$k_{2nl} = \frac{\varpi C_n^* \int_0^m T(\tau) e^{-2\pi i l \tau} d\tau}{2\pi m\{ilm + \beta_n^2 + i\varpi(1 + \varpi_2)\}},$$

$$T(\tau) = 4\pi F(\tau)\varpi + e^{-\tau}[\varpi - 2\pi(\beta_n^2 + i\varpi(1 + \varpi_2))],$$

$$F(\tau) = i\left\{\begin{matrix} \varepsilon_1 \varpi_2 \left[\begin{matrix} 2\pi\varpi_1 \tau \cdot \cos 2\pi(\varpi_1 \tau + \gamma) + \\ \sin 2\pi(\varpi_1 \tau + \gamma) \end{matrix}\right] + \\ i(1 + \varpi_2) \end{matrix}\right\} \times e^{2\pi i \varepsilon_1 \varpi_2 \tau \cdot \sin 2\pi(\varpi_1 \tau + \gamma)}$$

Im being the imaginary part of a complex function.

Apparently, $$\mathrm{Re}\ j_z = \varpi \left\{\begin{matrix} a_{11}\sin 2\pi\phi_1 + a_{12}\cos 2\pi\phi_1 + \\ \varepsilon_2[(1 + \varpi_2)a_{21} + \dot{a}_{22}]\sin 2\pi\phi_2 + \\ \varepsilon_2[(1 + \varpi_2)a_{22} + \dot{a}_{21}]\cos 2\pi\phi_2 \end{matrix}\right\} \tag{20}$$

$$\mathrm{Re}\, b_r = \frac{P}{r}\left\{\begin{matrix} a_{11}\sin 2\pi\phi_1 + a_{12}\cos 2\pi\phi_1 + \\ 2\varepsilon_2(a_{21}\sin 2\pi\phi_2 + a_{22}\cos 2\pi\phi_2) \end{matrix}\right\}, \tag{21}$$

$$\mathrm{Re}\, b_\varphi = -\left\{\begin{matrix} a'_{11}\cos 2\pi\phi_1 - a'_{12}\sin 2\pi\phi_1 + \\ \varepsilon_2(a'_{21}\cos 2\pi_2 - a'_{22}\sin 2\pi\phi_2) \end{matrix}\right\}, \tag{22}$$

where $$\dot{a}_{ik} = \frac{\partial a_{ik}}{\partial \tau};\ \dot{a}'_{ik} = \frac{\partial a_{ik}}{\partial r}.$$

Azimuthal component of EMBF is:

$$f_\varphi = \frac{\varpi p}{r}\left\{\frac{1}{2}(a_{11}^2 + a_{12}^2) + a_{11}a_{12}\sin 4\pi\phi_1 + \frac{1}{2}(a_{12}^2 - a_{11}^2)\cos 4\pi\phi_1 + \varepsilon_2^2\left[\begin{matrix} f_1 a_{21} + f_2 a_{22} + (a_{21}f_2 + a_{22}f_1)\sin 4\pi\phi_1 + \\ (a_{22}f_2 - a_{21}f_1)\cos 4\pi\phi_2 \end{matrix}\right] + \varepsilon_2[a_{11}\sin 2\pi\phi_1 + a_{12}\cos 2\pi\phi_1][(f_1 + 2a_{21})\sin 2\pi\phi_2 + (f_2 + 2a_{22})\cos 2\pi\phi_2]\right\}, \tag{23}$$

where $$f_1 = (1 + \varpi_2)a_{21} + \dot{a}_{22};\ f_2 = (1 + \varpi_2)a_{22} + \dot{a}_{21}.$$

Radial component of EMBF is:

$$f_r = -\frac{\varpi}{r}\left\{\begin{matrix} (a_{12}a'_{11} - a_{11}a'_{12}) + (a_{11}a'_{11} - a_{12}a'_{12})\sin 4\pi\phi_1 + \\ (a_{12}a'_{11} + a_{11}a'_{12})\cos 4\pi\phi_1 + \\ \varepsilon_2^2\left[\begin{matrix} (f_2 a'_{21} - f_1 a'_{22}) + (f_1 a'_{21} - f_2 a'_{22})\sin 4\pi\phi_2 + \\ (f_2 a'_{21} + f_2 a'_{22})v\cos 4\pi\phi_2 \end{matrix}\right] + \\ \varepsilon_2[a_{11}\sin 2\pi\phi_1 + a_{12}\cos 2\pi\phi_1]\cdot\left[\begin{matrix} a'_{21}\cos 2\pi\phi_2 - \\ a'_{22}\sin 2\pi\phi_2 \end{matrix}\right] + \\ \left[\begin{matrix} (f_2\cos 2\pi\phi_2 + f_1\sin 2\pi\phi_2) \\ (a'_{11}\cos 2\pi\phi_1 - a'_{12}\sin 2\pi\phi_1) \end{matrix}\right] \end{matrix}\right\}. \tag{24}$$

The first four terms in equations (21) and (22) describe the forcing influence of a non-modulated reference RMF. The terms proportional to $\epsilon^2_2$ describe the forcing influence of the modulated portion of RMF, whereas the terms proportional to $\epsilon_2$ describe EMBF oscillations and waves arising as a result of the interaction between modulated and non-modulated portions of RMF. Apparently, amplitude and frequency modulation increases by more than an order of magnitude the stationary EMBF component, which increases mean rotation velocity of the medium and adds four EMBF waves and two oscillations with different frequencies and initial phases acting in azimuthal and radial directions, which additionally intensifies the medium mixing.

The above analysis completely takes into account the contribution of the phenomenon of current and magnetic field attenuation in the vicinity of the lateral surface of a conducting cylinder (either solid or liquid), the so called skin-effect, to the magnitude and spatial distribution of EMBF generated by amplitude- and frequency-modulated currents. It makes it possible to choose an optimal ratio of electromagnetic parameters for the specified region, dimensions, and medium conductivity.

Estimations of the efficiency of the proposed method are based on a methodology of computing angular velocity of quasi-solid core of turbulent rotary flows excited by RMF that can be described by the following simple formula:

$$\Omega = \frac{Q}{2}\left(\sqrt{1 + \frac{4}{Q}} - 1\right),$$

where $Q = Ha_a^2 \cdot \delta_z / Re_\omega \cdot C_0$; $Ha_a = B_a \cdot R_0 \sqrt{\sigma/\eta}$ is the active value of the Hartmann number; $Re_\omega = \omega R_0^2/\nu$ is the Reynolds number determined by RMF rotation velocity on the wall of the vessel containing the melt; $\delta_z = Z_0/R_0$; $C_0$ is an empirical constant taking into account the effect of RMF modulation (for non-modulated RMF $C_0$=0.0164, and it is higher for modulated RMF); $B_a$ is a mean acting value of the magnetic induction in the vessel; $R_0$ is the inner radius of the vessel wall, $\eta$ is the dynamic viscosity of the melt; $\nu$ is the kinematic viscosity of the melt; and $Z_0$ is the height of the liquid phase column.

The kinetic energy of a rotary flow $E_{kin}=J\Omega^2/2$; where J is the rotating fluid moment of inertia; and the hydraulic efficiency is determined as a ratio of kinetic to electric energy consumed to drive and sustain the rotary motion:

$$\eta_{hydr}\approx E_{kin}/E_{el}.$$

It is noteworthy that the electric energy consumption in the case of modulated RMF is somewhat higher than that of nonmodulated RMF.

An m-phase system of modulated helical currents generates a magnetic field traveling along a helical line (i.e., rotating while axially traveling) in a conducting medium, which, in turn, induces a mirror system of currents traveling in the same direction. Interaction of the induced currents with the magnetic field gives rise to EMBF acting both in the direction of the magnetic field travel and in the perpendicular direction, wherein the fields include stationary and non-stationary components.

Under the action of the stationary EMBF component, in a general case, a helical flow of a conducting fluid arises (in particular, rotation and axial flow), which has, as a rule, a turbulent structure. Under the action of non-stationary components, waves and oscillations of various frequencies and directions are excited in the medium, which turbulize the flow structure to a greater extent. The energy of this constituent of turbulence is derived from the work accomplished by non-stationary forces acting upon the flow, and not from the mean flow energy. As a result, the stirring depth of the liquid is drastically increased, which leads to a rapid homogenization of temperature and impurity concentration.

When using an additional frequency- and amplitude-modulated current density field excited using km electrodes, (where m is the number of phases and k is the number of electrodes per phase), additional EMBF field components appear, arising due to the interaction of the current density field with the magnetic fields, which leads to a further intensification of the forcing influence and to the extension of the application range of said methods to the media with ionic conductivity (e.g., electrolytes, salt and slag melts, etc.).

Figure 18:
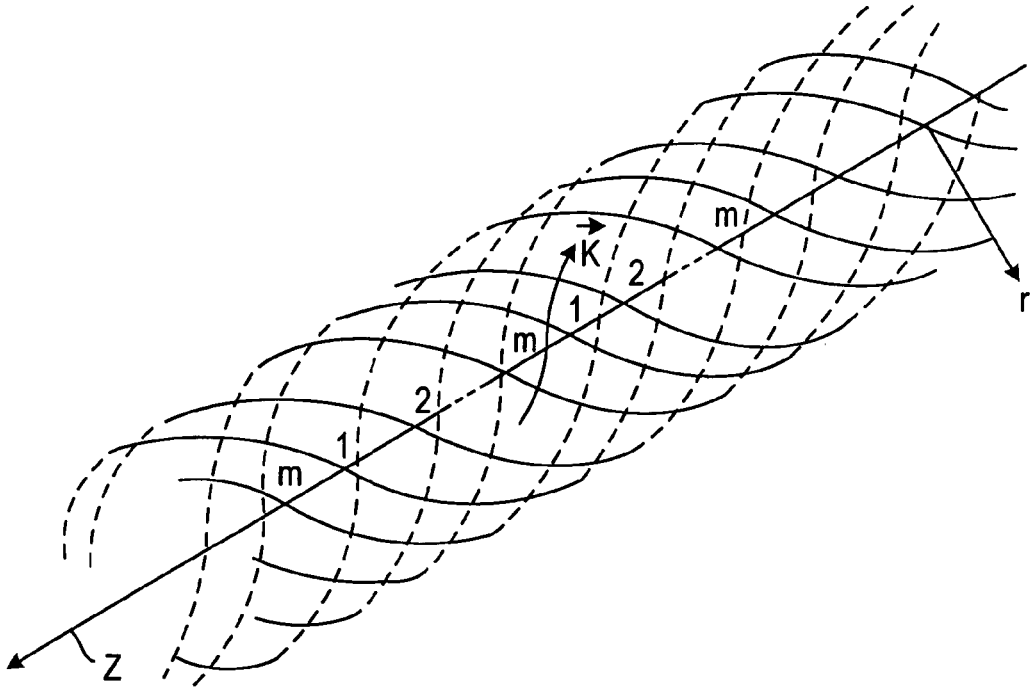
FIG. 18 is a schematic presentation of an m-phase system of helical currents exciting a helically traveling magnetic field.
Figure 19:
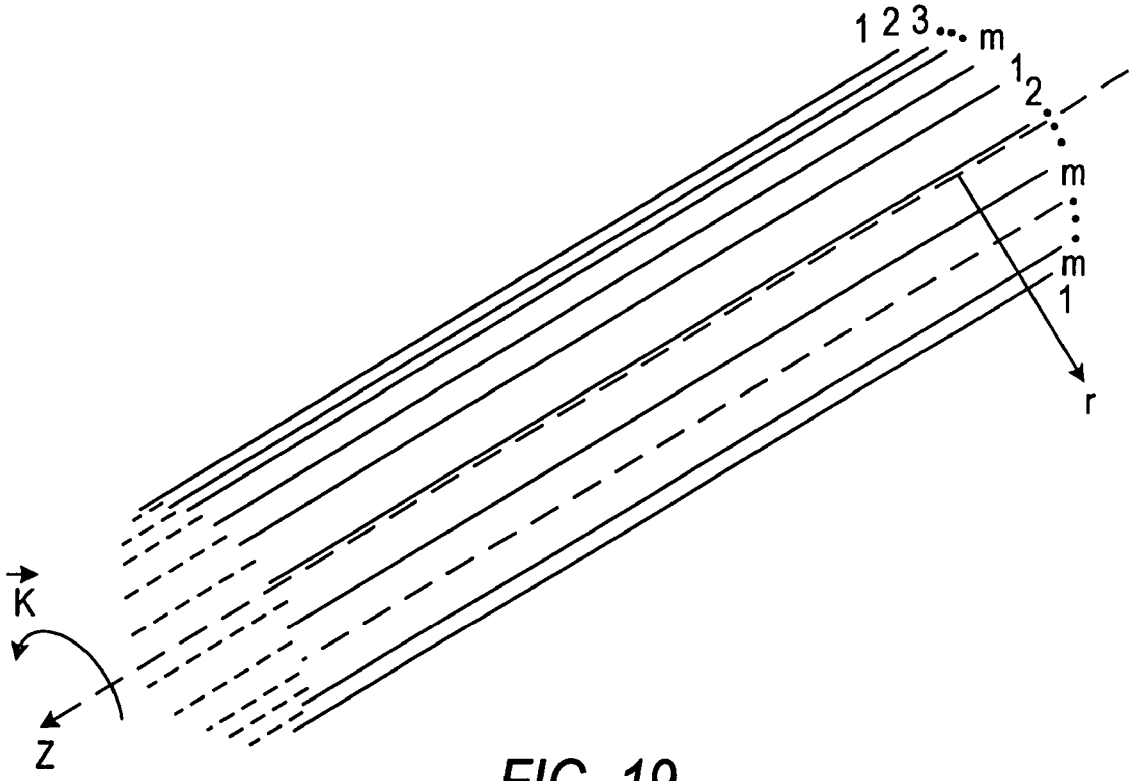
FIG. 19 is a schematic presentation of an m-phase system of axial currents exciting RMF.
Figure 20:
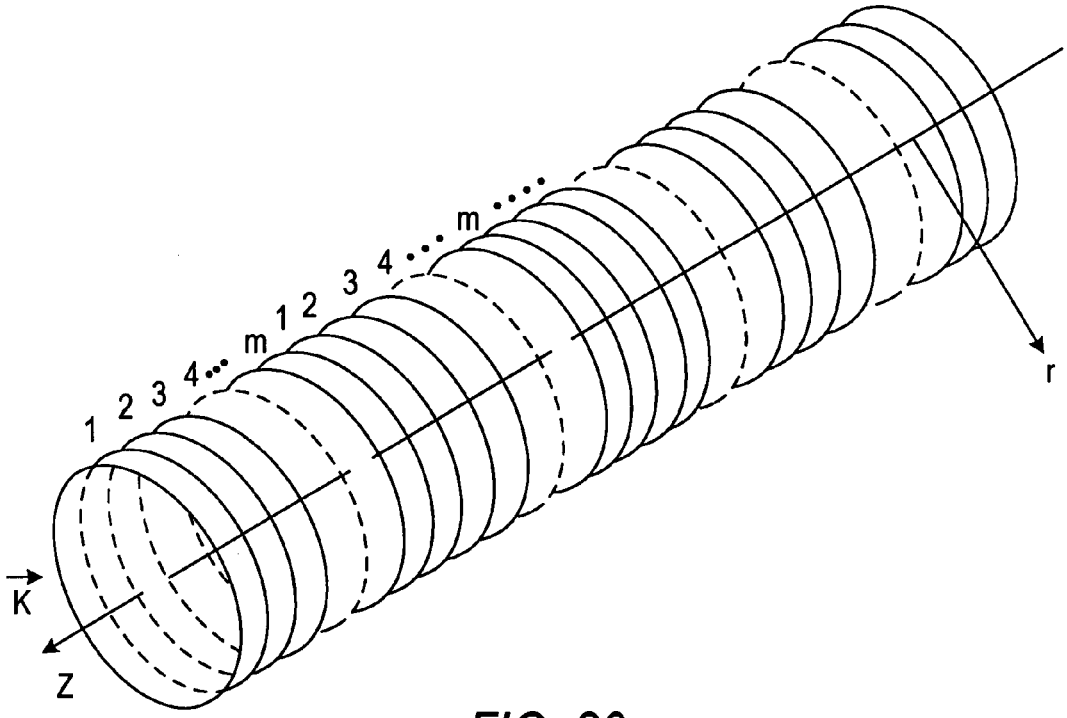
FIG. 20 is a schematic presentation of an m-phase system of annular currents exciting an axially traveling magnetic field.

FIGS. 18-20 represent spatial configurations of the simplest current systems exciting, respectively, helical, rotating and axially traveling magnetic fields modified by the method of the present invention.

Figure 21:
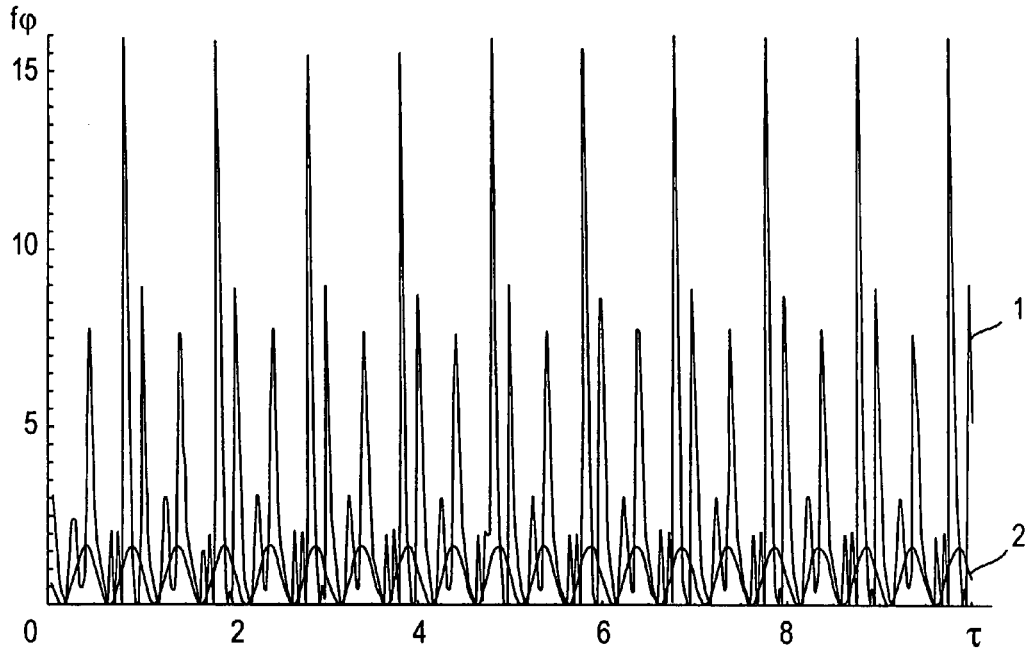
FIG. 21 shows a dependence of the amplitude of dimensionless EMBF on dimensionless time: curve 1 corresponds to frequency- and amplitude-modulated RMF; and curve 2 corresponds to non-modulated RMF.

FIG. 21 shows dependencies of dimensionless EMBF excited, respectively, by modulated and non-modulated RMF, on time. Apparently, at the indicated values of the parameters, peak EMBF values excited by modulated RMF is approximately 10-fold higher than in the case of non-modulated RMF.

The following paragraphs restate the basic teachings of Superwaves as they relate to metallurgy and the related sciences as disclosed herein.

The technology of SuperWaves -Excited MHD is the application of uniquely modulated carrier waves as the excitation current in generating rotating magnetic fields increases the turbulence in stirred liquids, thereby increasing their melting and mixing rates and improving the properties of the cast metals.

As stated above, SuperWaves may be understood to be carrier waves with modulations of their amplitude, frequency and/or phase. Oscillation modulation is a change in oscillation parameters with time according to a periodic regulation. The base modulated wave (or oscillation) may be referred to as a carrier wave, and its frequency may be called carrier frequency.

Mathematically, SuperWaves are shown to be of significant importance to mixing in liquid flows. As applied to metallurgical processes, an increase in turbulent fluctuation intensity over sufficiently small scales is extremely important in connection with the thermal and chemical homogenization of melts.

The rotation of liquid metal in a rotating magnetic field is practically always turbulent to some extent. Even weak rotation of liquid melts improves their characteristics since some vortical fluctuations are formed. However, simple rotation (at a constant angular velocity in the flow core) generates, to the first approximation, classical Kolmogorov's turbulence (see, e.g., FIG. 22). In this case, turbulent energy depends on the dimensions of turbulent vortices as $E=\epsilon^{2/3}r^{2/3}$ or, in the frequency region, as $E(\omega)\sim\omega^{-5/3}$, where $\epsilon$ is the energy flux over the spectrum per unit mass, $\omega$ is the frequency, and $E(\omega)$ is the spectral energy density.

In the case of simple rotation, $$E(\omega)\sim E_0(\omega_0)(\omega_0/\omega)^{5/3}, \tag{28}$$

where $E_0(\omega_0)$ is the energy injected into the system, which corresponds to the characteristic scale value $L_0$. Thus, in this case, to obtain vortices required for thermal and chemical homogenization, we must introduce energy into the system in the scale $L_0$, and after the energy cascade over the spectrum, we will obtain the following vorticity level at the frequency $\omega$: $E(\omega)\sim E_0(\omega)(\omega_0/\omega)^{5/3}$. If $\Delta\omega=\omega/\omega_0$ is sufficiently high, then the respective vorticity is small.

If, side by side with mean rotation, external force fluctuations at the frequency $\omega$ exceeding $\omega_0$ arise in the system, we can expect an increased number of vortices at this frequency. The situation is similar to the appearance of the Karman street, when peaks at the frequencies multiple to the main vortex arise in the spectrum. Here we can estimate the vorticity arising at the specified frequency $\omega$ as follows. Let $E_0\sim\alpha_1(F_0/\omega_0)^2$ be the turbulent energy supplied by the mean flow without fluctuations to the vortices with the frequency $\omega_0$. If fluctuations arise in the system due to an external force with the frequency $\omega$, their energy contribution is:

$$E'(\omega)\sim\alpha_2[F(\omega)/\omega]^2. \tag{29}$$

Hence, at the frequency $\omega$, the relative vorticity magnitude is as follows:

$$E'(\omega)/E(\omega)\sim(\alpha_2/\alpha_1)(F/F_0)^2(\omega_0/\omega)^{1/3}. \tag{30}$$

Figure 22:
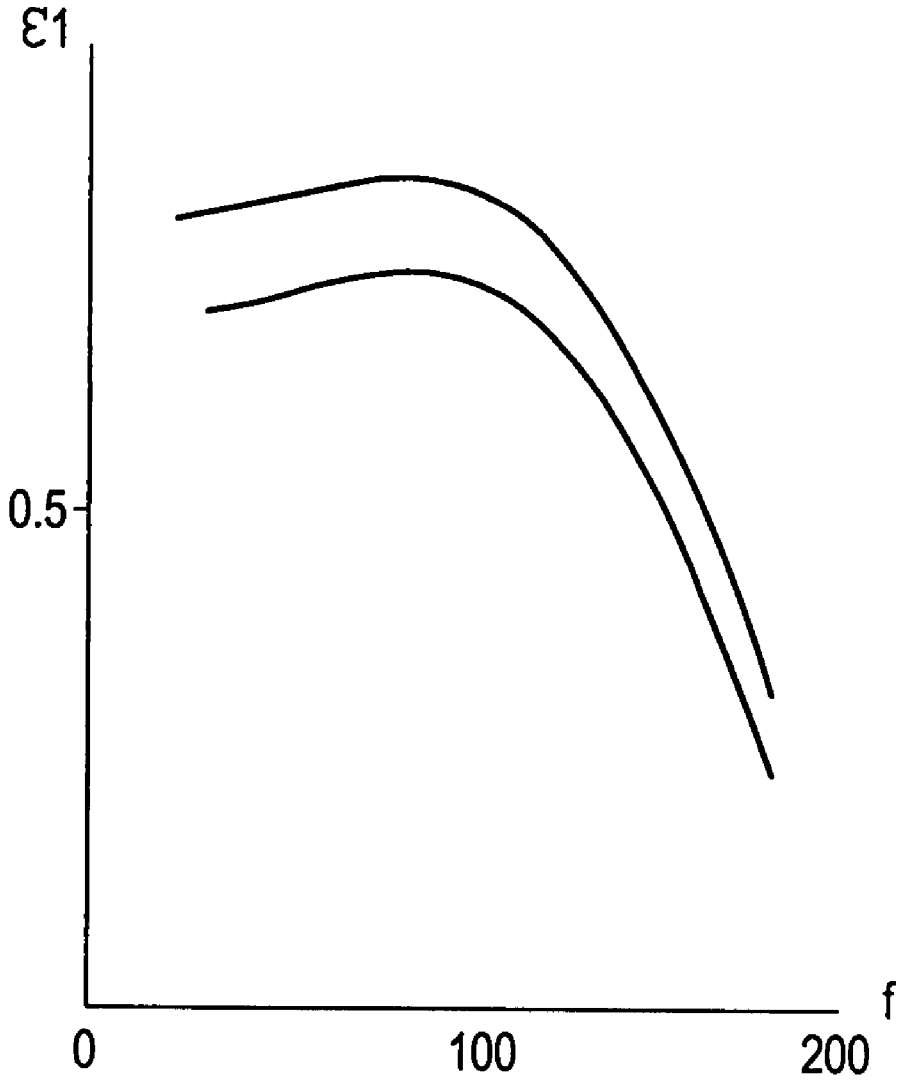
FIG. 22 shows a dependence of turbulent regular wave energy density on frequency at different mean flow velocities in the absence of SuperWaves.

The parameters $\alpha_1$ and $\alpha_2$ characterize the medium response to the external force action. If the forces F and $F_0$ are of the same nature, then $\alpha_1$and $\alpha_2$ should not differ greatly, and their ratio is close to 1 (FIG. 22). This magnitude can be determined more exactly experimentally.

Figure 23:
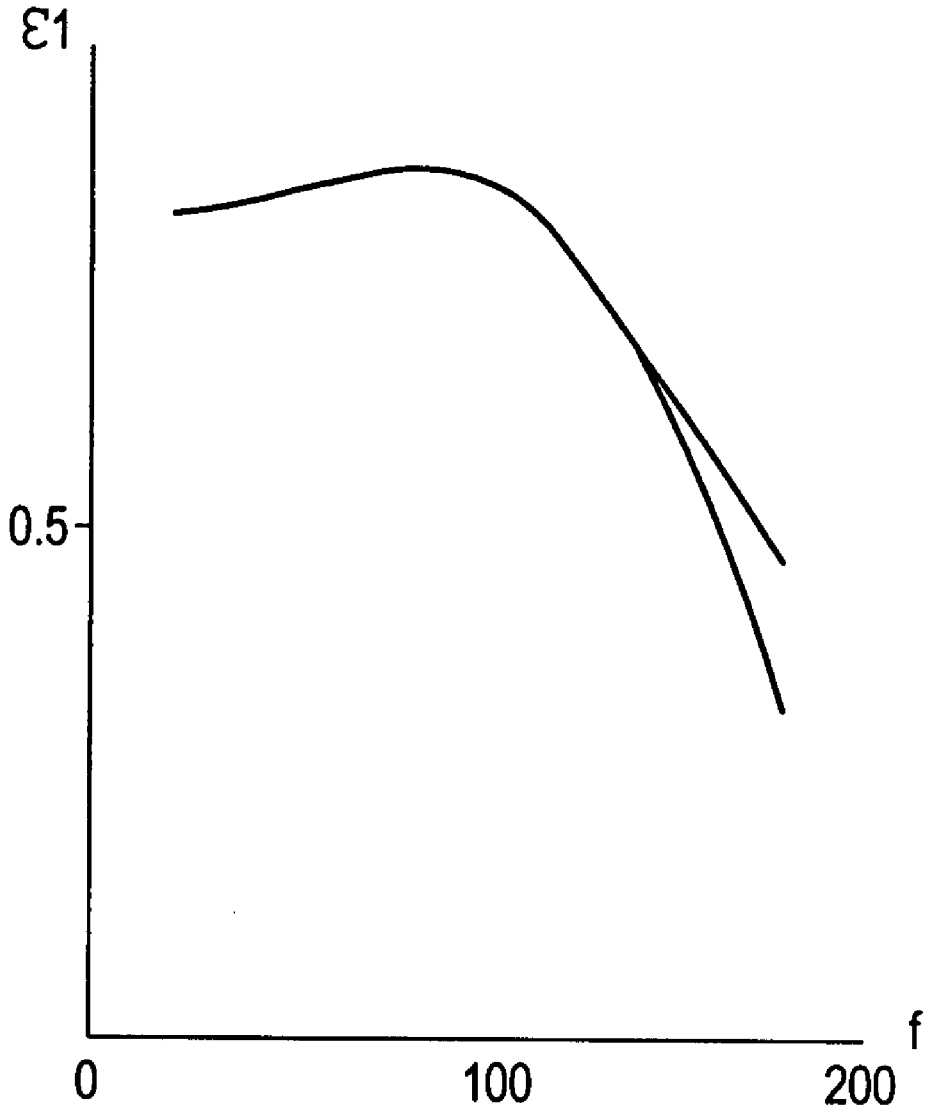
FIG. 23 shows a dependence of turbulent energy density on frequency at flow velocity in the presence of SuperWaves.

When SuperWaves are used to modulate the current, computations of electromagnetic forces excited by this frequency- and amplitude-modulated current have shown that additional turbulent force is created in the liquid (see, e.g., FIG. 23). Besides the mean force $F_0$ fluctuating with the amplitude $\omega_0\sim50$ Hz, a pulsed influence with the amplitude $F\sim7\div8\ F_0$ and frequency $\omega\sim2.3\div2.5\ \omega_0$ arises.

According to (30), we obtain that in such a system turbulent fluctuations with the frequency w should grow according to:

$$E'(\omega)/E(\omega)\sim(\alpha_2/\alpha_1)(7\div8)^2(2.3\div2.5)^{-1/3}\sim(36\div48)\ (\alpha_2/\alpha_1) \quad (31)$$

Hence, the effect of a modulated external force on molten metal should result in more intense homogenization than the effect of a non-modulated force. Thus, to homogenize a turbulent medium, one can increase the mean rotation rate by increasing the inductor power (and Re) as in FIG. 22, increase the turbulent force using SuperWaves© at lower rotation rate as in FIG. 23 or use both effects.

Experimentally, SuperWaves increased the melting rate of solids added to liquid melts, increased the density of metal solidified in RMF and behaved predictably according to the mathematics above.

Figure 24:
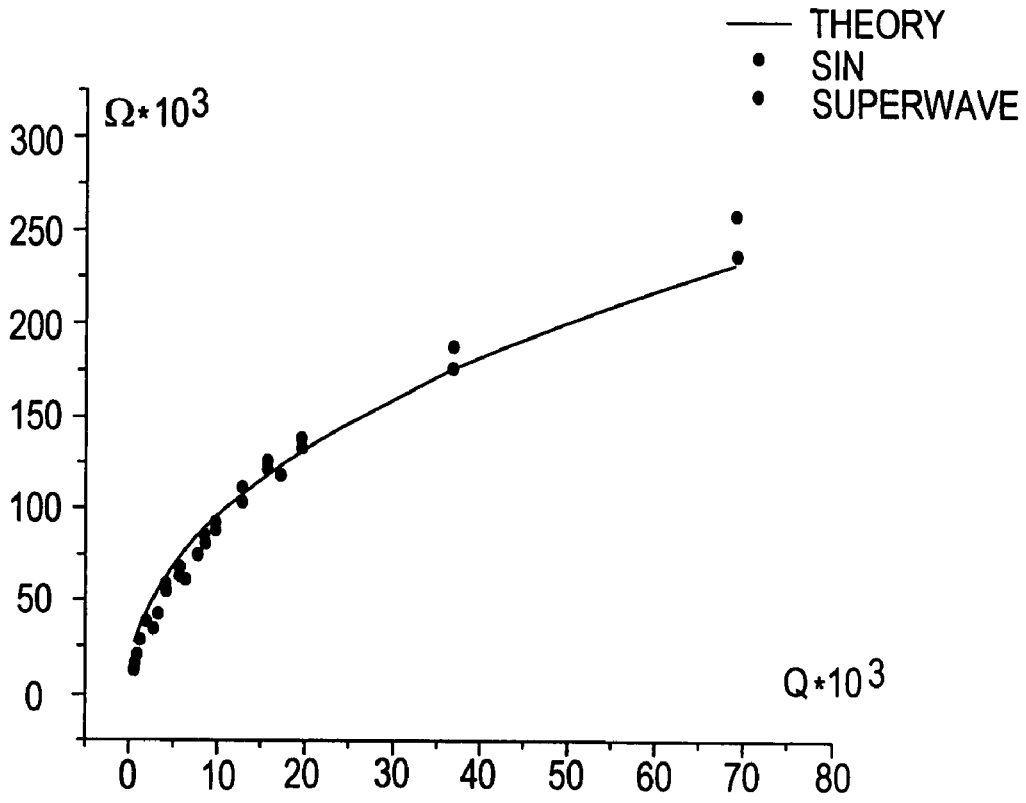
FIG. 24 shows a dependence of the ratio of the mean turbulent flow velocity to the magnetic field angular velocity on a universal criterion constructed on the basis of MHD process parameters.

FIG. 24 is an outcome of the initial experiments on turbulent flow related to SuperWave© excitation of the RMF. The ratio of the average angular velocity to the magnetic field angular velocity, $\Omega/\omega$, is plotted against Q, a parameter representing a collection of process conditions including $Ha^2$ (representing the ratio between electromagnetic force to the viscous force). Q is also proportional to the current-squared in the coils of the stirring unit. As the current on the coils was increased (increasing Ha), the angular velocity increased. The solid curve is a universal theoretical relationship between angular velocity and the parameter Q. The upper data points are for non-modulated RMF and-the (lower) points are for the SuperWaves-modulated RMF.

The mentioned universal curve shown in FIG. 24 makes it possible to choose the necessary velocity regime (the required Reynolds number) at arbitrary combinations of the current amplitude and frequency.

Figure 25:
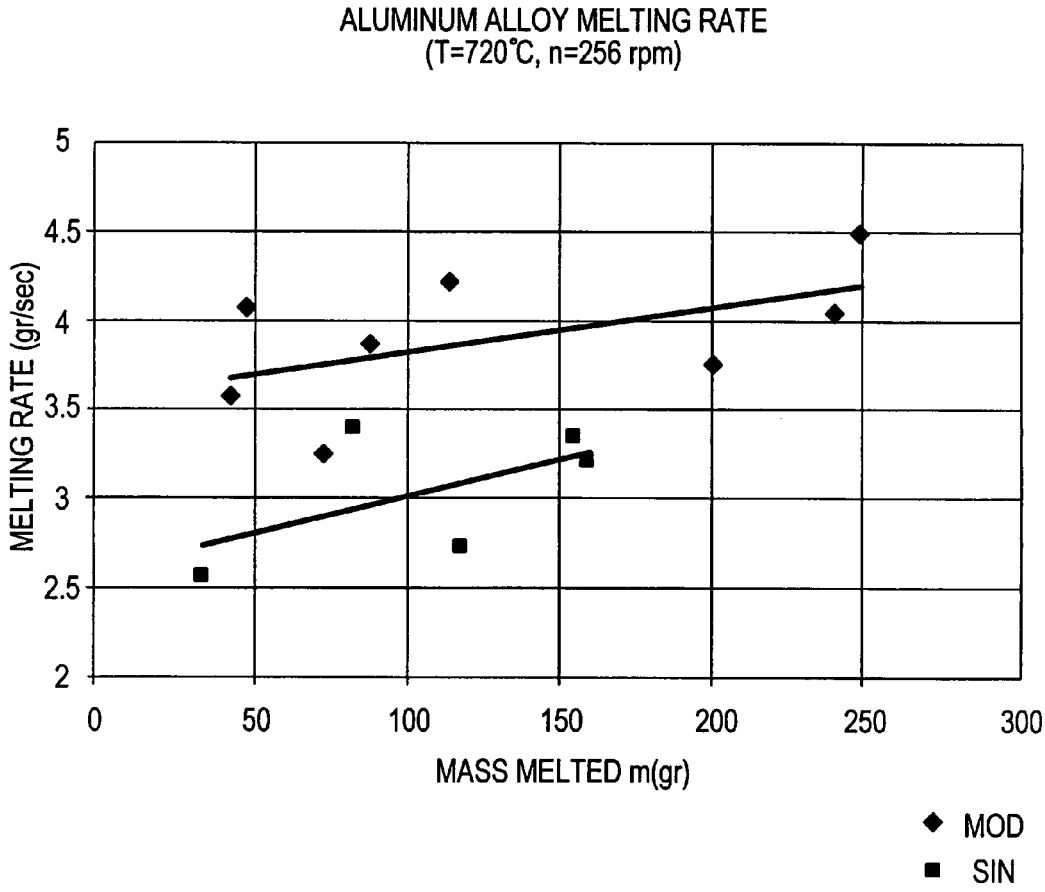
FIG. 25 shows a dependence of melting rate associated with SuperWaves at EMS on melted mass increment: 1—in the presence of Superwaves; and 2—in the absence of SuperWaves.

The increased turbulence created by SuperWaves acts like a drag on the stirring velocity thus reducing its average value. The difference in velocity seen in the data of FIG. 25 is consistent with an extra drag force stemming from increased turbulence created by SuperWaves during stirring. Therefore, SuperWaves have the potential to increase the rate of mixing without the overhead of unwanted and expensive higher stirring velocities.

The effect of RMF modulated by SuperWaves was studied experimentally on molten aluminum alloy.

The results of the melting rate experiments are shown in FIG. 25. This result shows that melting rate may be increased independently of stirring velocity. Obviously, the use of SuperWaves increases the melting rate, with other conditions being equal, by about 22%. Thus the melting experiments are an essential verification of the ability of SuperWaves to create turbulence and effectively use it to increase the mixing rate in metallurgical processes.

Figure 26:
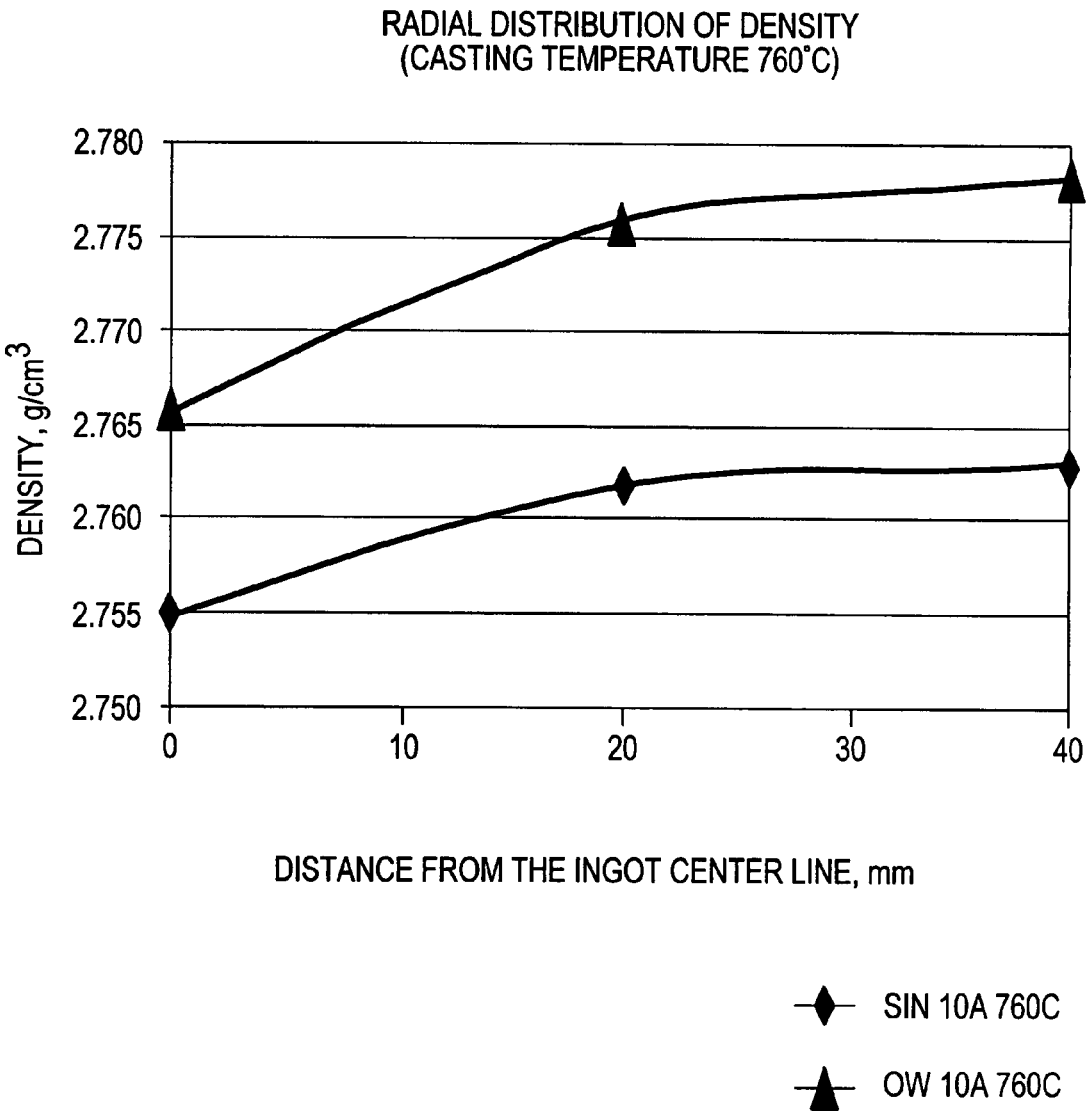
FIG. 26 shows a dependence of ingot density on distance from ingot center line: 1—in the presence of Superwaves; and 2—in the absence of SuperWaves.

Aluminum alloy 201 was solidified under stirring conditions similar to the melting experiment. The difference being that the melt was allowed to completely solidify under the action of RMF. Examination of the solidified ingots revealed that the SuperWave-excited RMF produced an ingot that was significantly denser than the ingot solidified using a non-modulated RMF (see FIG. 26). This density increase is equivalent to removing 5.7 billion micro-pores per cubic centimeter of cast metal. This suggests that the turbulent mixing action, mathematically predicted for SuperWaves, was created and was beneficial to metals processing.

What is claim is:

1. A method of intensification of melt stirring in induction m-phase furnaces, wherein currents feeding primary windings of an m-phase furnace transformer are hierarchically frequency and amplitude-modulated.

2. A method according to claim 1, wherein said currents generate a helically traveling magnetic field and said magnetic field is applied after filling a shaft with melt 1/n of the final melt height in the shaft.

3. A method according to claim 2, wherein the helically traveling rotating magnetic field (RMF) affects a melt produced in electric-arc furnaces and reverberatory furnaces for casting aluminum alloys.

* * * * *